US009212426B2

(12) United States Patent
Shibata et al.

(10) Patent No.: US 9,212,426 B2
(45) Date of Patent: Dec. 15, 2015

(54) RUST PREVENTIVE OIL COMPOSITION

(71) Applicant: JX NIPPON OIL & ENERGY CORPORATION, Tokyo (JP)

(72) Inventors: Junichi Shibata, Tokyo (JP); Koichi Yoshida, Tokyo (JP); Tadaaki Motoyama, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days.

(21) Appl. No.: 14/386,593

(22) PCT Filed: Oct. 29, 2012

(86) PCT No.: PCT/JP2012/077883
§ 371 (c)(1),
(2) Date: Sep. 19, 2014

(87) PCT Pub. No.: WO2013/140651
PCT Pub. Date: Sep. 26, 2013

(65) Prior Publication Data

US 2015/0096463 A1 Apr. 9, 2015

(30) Foreign Application Priority Data

Mar. 23, 2012 (JP) ..... 2012-067772

(51) Int. Cl.

| | |
|---|---|
| ***C23F 11/00*** | (2006.01) |
| ***C10M 101/02*** | (2006.01) |
| ***C10M 129/26*** | (2006.01) |
| ***C10M 129/40*** | (2006.01) |
| ***C10M 129/68*** | (2006.01) |
| ***C10M 133/04*** | (2006.01) |
| ***C23F 11/10*** | (2006.01) |
| ***C10M 135/10*** | (2006.01) |
| ***C10M 139/00*** | (2006.01) |
| ***C10M 159/06*** | (2006.01) |
| ***C10M 169/04*** | (2006.01) |
| ***C10M 133/16*** | (2006.01) |
| ***C23F 11/14*** | (2006.01) |

(52) U.S. Cl.

CPC ..... *C23F 11/10* (2013.01); *C10M 101/02* (2013.01); *C10M 129/26* (2013.01); *C10M 129/40* (2013.01); *C10M 129/68* (2013.01); *C10M 133/04* (2013.01); *C10M 133/16* (2013.01); *C10M 135/10* (2013.01); *C10M 139/00* (2013.01); *C10M 159/06* (2013.01); *C10M 169/04* (2013.01); *C10M 169/045* (2013.01); *C23F 11/143* (2013.01); *C10M 2203/1006* (2013.01); *C10M 2205/12* (2013.01); *C10M 2205/16* (2013.01); *C10M 2207/12* (2013.01); *C10M 2207/289* (2013.01); *C10M 2215/04* (2013.01); *C10M 2215/08* (2013.01); *C10M 2219/044* (2013.01); *C10M 2219/046* (2013.01); *C10M 2227/061* (2013.01); *C10N 2220/022* (2013.01); *C10N 2230/12* (2013.01); *C10N 2230/26* (2013.01); *C10N 2240/401* (2013.01); *C10N 2240/402* (2013.01); *C10N 2240/404* (2013.01); *C10N 2240/405* (2013.01); *C10N 2240/406* (2013.01); *C10N 2240/407* (2013.01); *C10N 2240/408* (2013.01)

(58) Field of Classification Search

CPC ... C23F 11/00; C10M 101/02; C10M 129/26; C10M 129/40; C10M 159/68; C10M 133/04; C10M 133/16; C10M 135/10; C10M 139/00; C10M 159/06; C10M 169/04; C10M 169/045

USPC ..... 106/14.26, 14.27, 14.28, 14.29

See application file for complete search history.

(56) References Cited

U.S. PATENT DOCUMENTS 8,303,850 B2 * 11/2012 Shibata et al. ..... 252/388

FOREIGN PATENT DOCUMENTS

| | | | |
|---|---|---|---|
| CN | 101415807 | 4/2009 | |
| JP | 2001-089795 | 4/2001 | |
| JP | 2001-089798 | 4/2001 | |
| JP | 2002-212577 | 7/2002 | |
| JP | 2011-80141 | 4/2011 | |
| WO | WO 2011/030615 A1 * | 3/2011 | ..... C23F 11/00 |

OTHER PUBLICATIONS

Machine Translation of Japanese Patent Specification No. JP 2002-212577 A (Jul. 2002).*

International Search Report of PCT/JP2012/077883 mailed Nov. 27, 2012.

English translation of the International Preliminary Report on Patentability of PCT/JP2012/077883 mailed Oct. 2, 2014.

Partial translation of Junichi Shibata "Required Properties of Rust-Preventive Oil and Criteria for Selecting the Same," ENEOS Technical Review, vol. 50, No. 3, lines 14 to 31 on p. 45.

Office Action issued in China Counterpart Patent Appl. No. 201280071754.5, dated Aug. 21, 2015.

* cited by examiner

*Primary Examiner* — Anthony J Green

(74) *Attorney, Agent, or Firm* — Greenblum & Bernstein, P.L.C.

(57) ABSTRACT

A rust preventive oil composition containing a first mineral oil that is a mineral oil having a kinematic viscosity at 40° C. of 6 $mm^2/s$ or less, a second mineral oil that is a mineral oil having a kinematic viscosity at 40° C. of 250 $mm^2/s$ or more, a fatty acid amine salt, an ester, and one or more rust preventive agents selected from the group consisting of a sarcosine-type compound, a nonionic surfactant, a sulfonic acid salt, an amine, a carboxylic acid, a fatty acid amine salt, a carboxylic acid salt, a paraffin wax, an oxidized wax salt, and a boron compound.

4 Claims, No Drawings

RUST PREVENTIVE OIL COMPOSITION

TECHNICAL FIELD

The present invention relates to a rust preventive oil composition.

BACKGROUND ART

In many cases, metal members comprising iron as a main component are manufactured through working such as cutting and pressing. During manufacturing or when shipping as products, a rust preventive oil is applied for the purpose of preventing discoloration called rust or stain. The main purpose of the use of the rust preventive oil is to form a film on the metal surface to block oxygen, and thereby preventing oxidation of metal, that is, rust.

However, if a chloride or water is attached to the metal surface, it becomes difficult for the rust preventive oil to sufficiently exert its effect. For example, in the case where a metal working oil containing a chlorine extreme-pressure agent is used for a preceding process of working, in order to obtain a sufficient rust preventive property, the chloride that is a rust generation factor needs to be removed in advance. Thus, in many cases, after washing and removing the chloride with a finger print remover type rust preventive oil called NP-0 specified by JIS K 2246, a rust preventive oil is used.

Furthermore, when a water-soluble working oil is used, moisture is considered to be attached. Also in this case, moisture needs to be removed before using a rust preventive oil as is the case in chlorine. An oil solution whose water displacement property is enhanced is sometimes used to remove water. The water displacement property herein means performance by which an additive agent in the oil solution penetrates between water and metal, and water is removed from the metal surface. Oil solutions corresponding to NP-3-1 and NP-3-2 classified by JIS K 2246 also have a water displacement property, but this relates to a rust preventive property when moisture is mixed in a rust preventive oil and does not specify performance capable of removing water from a metal surface (see Non Patent Literature 1). Hereinafter, in order to avoid confusion, performance to remove water from a metal surface is called a "water removal property", and is distinguished from the water displacement property specified by JIS.

As described above, in order to carry out rust preventive treatment for metal to which moisture is attached, firstly, moisture is removed by washing with an oil solution which excels in water removal property, and furthermore, a rust preventive oil needs to be applied. However, in many cases, the two processes, water removal and then rust prevention, cannot be carried out due to causes such as productivity and cost, and an oil solution capable of unifying treatment is required. However, it is very much a situation that an oil solution having a water removal property lacks a rust preventive property and a sufficient rust preventive property cannot be obtained by applying a rust preventive oil without a water removal process (for example, see Patent Literatures 1 and 2).

In order to unify processes, it is necessary to impart a sufficient rust preventive property (rust preventive performance) to an oil solution (washing agent) having water removal performance. However, a low-viscosity oil solution is advantageous for rapid water removal, whereas an applied oil film needs to have high viscosity for a sufficient rust preventive property. When viscosity is made to be intermediate so as to achieve both of the two kinds of performance, either performance may be insufficient.

CITATION LIST

Patent Literature

Patent Literature 1: Japanese Patent Application Laid-Open No. 2001-89795

Patent Literature 2: Japanese Patent Application Laid-Open No. 2001-89798

Non Patent Literature

Non Patent Literature 1: Junichi Shibata, ENEOS Technical Review, vol. 50, No. 3, page 45

SUMMARY OF INVENTION

Technical Problem

The present invention has been made in view of these circumstances, and it is an object of the present invention to provide a rust preventive oil composition having performance to remove water attached to various parts after metal working and metal parts, such as steel sheets, bearings, steel balls, and guide rails, and capable of obtaining a sufficient rust preventive property.

Solution to Problem

The present inventors made extensive research for the solution of the above-described problem, and found that both a water removal property and a rust preventive property can be achieved by combining a specific base oil and a specific additive agent to complete the present invention.

That is, a rust preventive oil composition of the present invention contains:

a first mineral oil that is a mineral oil having a kinematic viscosity at 40° C. of 6 $mm^2/s$ or less, a second mineral oil that is a mineral oil having a kinematic viscosity at 40° C. of 250 $mm^2/s$ or more, a fatty acid amine salt, an ester, and one or more rust preventive agents selected from the group consisting of a sarcosine-type compound, a nonionic surfactant, a sulfonic acid salt, an amine, a carboxylic acid, a fatty acid amine salt, a carboxylic acid salt, a paraffin wax, an oxidized wax salt, and a boron compound.

The rust preventive oil composition of the present invention further preferably contains a third mineral oil that is a mineral oil having a kinematic viscosity at 40° C. of 10 $mm^2/s$ or more and 120 $mm^2/s$ or less.

Moreover, an aromatic component content of the above-described first mineral oil is preferably 3 mass % or less based on a total amount of the first mineral oil.

Furthermore, the rust preventive oil composition of the present invention preferably satisfies a requirement that time during which Grade A of rust generation (rust generation of 0%) is maintained in a neutral salt water spray test specified by JIS K 2246 "Rust preventive oils" is 16 hours or more.

Advantageous Effects of Invention

As described above, according to the present invention, a rust preventive oil composition capable of obtaining excellent water removal performance, and furthermore, suppressing rust generation for long periods of time is provided.

DESCRIPTION OF EMBODIMENTS

Hereinafter, a preferred embodiment of the present invention will be described in detail.

A rust preventive oil composition according to the embodiment of the present invention contains:

(A-1) a mineral oil having a kinematic viscosity at 40° C. of 6 $mm^2/s$ or less (first mineral oil), (A-2) a mineral oil having a kinematic viscosity at 40° C. of 250 $mm^2/s$ or more (second mineral oil), (B) a fatty acid amine salt, (C) an ester, and (D) one or more rust preventive agents selected from the group consisting of a sarcosine-type compound, a nonionic surfactant, a sulfonic acid salt, an amine, a carboxylic acid, a fatty acid amine salt, a carboxylic acid salt, a paraffin wax, an oxidized wax salt, and a boron compound.

The (A-1) mineral oil having a kinematic viscosity at 40° C. of 6 $mm^2/s$ or less (hereinafter, also referred to as low-viscosity base oil) and the (A-2) mineral oil having a kinematic viscosity at 40° C. of 250 $mm^2/s$ or more (hereinafter, also referred to as high-viscosity base oil) are constituents of a base oil. Hereinafter, an entire mixture of mineral oils containing (A-1) and (A-2) components is referred to as an (A) component or a mineral base oil.

The kinematic viscosity at 40° C. of the low-viscosity base oil is 6.0 $mm^2/s$ or less, preferably 5.0 $mm^2/s$ or less, more preferably 4.0 $mm^2/s$ or less, and further preferably 3.0 $mm^2/s$ or less. When the 1.5 kinematic viscosity exceeds the above-described upper limit, it becomes difficult to obtain a sufficient rust preventive property. Moreover, the kinematic viscosity at 40° C. of the low-viscosity base oil is preferably 0.5 $mm^2/s$ or more, more preferably 1.0 $mm^2/s$ or more, and further preferably 1.5 $mm^2/s$ or more. When the kinematic viscosity is less than the above-described lower limit, handleability tends to deteriorate.

The kinematic viscosity at 40° C. of the high-viscosity base oil is 250 $mm^2/s$ or more, preferably 300 $mm^2/s$ or more, more preferably 400 $mm^2/s$ or more, and further preferably 450 $mm^2/s$ or more. When the kinematic viscosity is less than the above-described lower limit, a rust preventive property deteriorates. Moreover, the kinematic viscosity at 40° C. of the high-viscosity base oil is preferably 700 $mm^2/s$ or less, more preferably 650 $mm^2/s$ or less, and further preferably 600 $mm^2/s$ or less. When the kinematic viscosity exceeds the above-described upper limit, stability of the rust preventive oil composition tends to become insufficient.

Examples of each of the (A-1) component and the (A-2) component include those having the above-described kinematic viscosity at 40° C. among paraffinic or naphthenic mineral oils and the like, which are obtainable by arbitrarily combining and applying one or two or more refining means such as solvent deasphalting, solvent extraction, hydrocracking, solvent dewaxing, catalytic dewaxing, hydrorefining, sulfuric acid washing, and clay treatment, with respect to lubricant oil distillate obtained by atmospheric distillation and vacuum distillation of crude oil.

Moreover, the aromatic component contained in the low-viscosity base oil is preferably 3 mass % or less. When the aromatic content in the low-viscosity base oil is 3 mass % or less, the work environment may be improved, for example, a reduction in odor and skin irritation, and furthermore, water separating performance when a large amount of water is mixed in the rust preventive oil composition may be improved, resulting in an effect of extending life of an oil solution even in the case of removing a large amount of water. The aromatic component means a value measured in conformity with Fluorescent indicator adsorption method of JIS K 2536-1996 "Liquid petroleum products-Testing method of components".

The content of the low-viscosity base oil is preferably 30 mass % or more, more preferably 40 mass % or more, and further preferably 50 mass % or more, and preferably 90 mass % or less, more preferably 85 mass % or less, and further preferably 80 mass % or less, based on the total amount of the composition. When the content of the low-viscosity base oil is less than the above-described lower limit, a rust preventive property tends to become insufficient, and even when it exceeds the above-described upper limit, a rust preventive property tends to become insufficient.

The content of the high-viscosity base oil is preferably 1 mass % or more, more preferably 2 mass % or more, and further preferably 3 mass % or more, and preferably 35 mass % or less, more preferably 25 mass % or less, and further preferably 20 mass % or less, based on the total amount of the composition. When the content of the high-viscosity base oil is less than the above-described lower limit, a rust preventive property tends to become insufficient, and when it exceeds the above-described upper limit, a water removal property tends to become insufficient.

The ratio of the high-viscosity base oil to the total of the low-viscosity base oil and the high-viscosity base oil is preferably 1 mass % or more, more preferably 2 mass % or more, and further preferably 3 mass % or more, and preferably 45 mass % or less, more preferably 35 mass % or less, and further preferably 25 mass % or less. When the ratio of the high-viscosity base oil is less than the above-described lower limit, a rust preventive property tends to decrease, and when it exceeds the above-described upper limit, a water removal property tends to decrease.

In addition to the above-described low-viscosity base oil and high-viscosity base oil, the (A) component can further contain (A-3) a mineral oil having a kinematic viscosity at 40° C. of 10 $mm^2/s$ or more and 120 $mm^2/s$ or less (hereinafter, also referred to as medium-viscosity base oil). By the combination of the (A-1) to (A-3) components, both a water removal property and a rust preventive property can be achieved at a higher level.

The kinematic viscosity at 40° C. of the medium-viscosity base oil is 10 $mm^2/s$ or more, preferably 15 $mm^2/s$ or more, more preferably 18 $mm^2/s$ or more, and further preferably 20 $mm^2/s$ or more, and 120 $mm^2/s$ or less, preferably 100 $mm^2/s$ or less, more preferably 80 $mm^2/s$ or less, and further preferably 70 $mm^2/s$ or less. When the kinematic viscosity is less than the above-described lower limit, a rust preventive property improving effect by the use of the medium-viscosity base oil tends to become insufficient, and when it exceeds the above-described upper limit, a water removal property improving effect by the use of the medium-viscosity base oil tends to become insufficient.

The content of the medium-viscosity base oil is preferably 5 mass % or more, more preferably 8 mass % or more, and further preferably 10 mass % or more, and preferably 30 mass % or less, more preferably 25 mass % or less, and further preferably 20 mass % or less, based on the total amount of the composition. When the content is within the above-described range, a rust preventive property improving effect and a water removal property improving effect by the addition of the medium-viscosity base oil may be effectively obtainable.

Moreover, in the case of using the medium-viscosity base oil, the ratio of the high-viscosity base oil to the total of the low-viscosity base oil, the medium-viscosity base oil, and the high-viscosity base oil is preferably 1 mass % or more, more preferably 2 mass % or more, and further preferably 3 mass % or more, and preferably 45 mass % or less, more preferably 35 mass % or less, and further preferably 25 mass % or less. When the ratio of the high-viscosity base oil is less than the above-described lower limit, a rust preventive property tends to decrease, and when it exceeds the above-described upper limit, a water removal property tends to decrease.

The content of the (A) component (the content of the entire base oil containing the low-viscosity mineral oil, the high-viscosity mineral oil, and the medium-viscosity base oil used as necessary) in the present embodiment is preferably 60 mass % or more, more preferably 70 mass % or more, and further preferably 75 mass % or more, and preferably 95 mass % or less, more preferably 90 mass % or less, and further preferably 85 mass % or less, based on the total amount of the composition.

Fatty acids which constitute the fatty acid amine salt as the (B) component may be saturated fatty acids or unsaturated fatty acids, and may be straight-chain fatty acids or branched fatty acids. Moreover, the number of carbon atoms thereof is not particularly limited, but those having 8 to 18 carbon atoms are preferable. Examples of the amine include monoamines, polyamines, and alkanolamines. Specifically, examples of the above-described monoamines include alkyl amines, such as monomethylamine, dimethylamine, trimethylamine, monoethylamine, diethylamine, triethylamine, monopropylamine (all isomers), dipropylamine (all isomers), tripropylamine (all isomers), monobutylamine (all isomers), dibutylamine (all isomers), tributylamine (all isomers), monopentylamine (all isomers), dipentylamine (all isomers), tripentylamine (all isomers), monohexylamine (all isomers), dihexylamine (all isomers), monoheptylamine (all isomers), diheptylamine (all isomers), monooctylamine (all isomers), dioctylamine (all isomers), monononylamine (all isomers), monodecylamine (all isomers), monoundecyl (all isomers), monododecylamine (all isomers), monotridecylamine (all isomers), monotetradecylamine (all isomers), monopentadecylamine (all isomers), monohexadecylamine (all isomers), monoheptadecylamine (all isomers), monooctadecylamine (all isomers), monononadecylamine (all isomers), monoicosylamine (all isomers), monohenicosylamine (all isomers), monodocosylamine (all isomers), monotricosylamine (all isomers), dimethyl(ethyl)amine, dimethyl(propyl)amine (all isomers), dimethyl(butyl)amine (all isomers), dimethyl(pentyl)amine (all isomers), dimethyl(hexyl)amine (all isomers), dimethyl(heptyl)amine (all isomers), dimethyl(octyl)amine (all isomers), dimethyl(nonyl)amine (all isomers), dimethyl (decyl)amine (all isomers), dimethyl(undecyl)amine (all isomers), dim ethyl(dodecyl)amine (all isomers), dimethyl (tridecyl)amine (all isomers), dimethyl(tetradecyl)amine (all isomers), dimethyl(pentadecyl)amine (all isomers), dimethyl (hexadecyl)amine (all isomers), dimethyl(heptadecyl)amine (all isomers), dimethyl(octadecyl)amine (all isomers), dimethyl(nonadecyl)amine (all isomers), dimethyl(icosyl)amine (all isomers), dimethyl(henicosyl)amine (all isomers), and dimethyl(tricosyl)amine (all isomers); alkenyl amines, such as monovinylamine, divinylamine, trivinylamine, monopropenylamine (all isomers), dipropenylamine (all isomers), tripropenylamine (all isomers), monobutenylamine (all isomers), dibutenylamine (all isomers), tributenylamine (all isomers), monopentenylamine (all isomers), dipentenylamine (all isomers), tripentenylamine (all isomers), monohexenylamine (all isomers), dihexenylamine (all isomers), monoheptenylamine (all isomers), diheptenylamine (all isomers), monooctenylamine (all isomers), dioctenylamine (all isomers), monononenylamine (all isomers), monodecenylamine (all isomers), monoundecenyl (all isomers), monododecenyl amine (all isomers), monotridecenylamine (all isomers), monotetradecenylamine (all isomers), monopentadecenylamine (all isomers), monohexadecenylamine (all isomers), monoheptadecenylamine (all isomers), monooctadecenylamine (all isomers), monononadecenylamine (all isomers), monoicosenylamine (all isomers), monohenicosenylamine (all isomers), monodocosenylamine (all isomers), and monotricosenylamine (all isomers); monoamines having an alkyl group and an alkenyl group, such as dimethyl(vinyl) amine, dimethyl(propenyl)amine (all isomers), dimethyl (butenyl)amine (all isomers), dimethyl(pentenyl)amine (all isomers), dimethyl(hexenyl)amine (all isomers), dimethyl (heptenyl)amine (all isomers), dimethyl(octenyl)amine (all isomers), dimethyl(nonenyl)amine (all isomers), dimethyl (decenyl)amine (all isomers), dimethyl(undecenyl)amine (all isomers), dimethyl(dodecenyl)amine (all isomers), dimethyl (tridecenyl)amine (all isomers), dimethyl(tetradecenyl) amine (all isomers), dimethyl(pentadecenyl)amine (all isomers), dimethyl(hexadecenyl)amine (all isomers), dimethyl (heptadecenyl)amine (all isomers), dimethyl(octadecenyl) amine (all isomers), dimethyl(nonadecenyl)amine (all isomers), dimethyl(icosenyl)amine (all isomers), dimethyl (henicosenyl)amine (all isomers), and dim ethyl(tricosenyl) amine (all isomers); aromatic-substituted alkylamines such as monobenzylamine, (1-phenylethyl)amine, (2-phenylethyl)amine (another name: monophenethylamine), dibenzylamine, bis(1-phenylethyl)amine, and bis(2-phenylethylene) amine (another name: diphenethylamine); cycloalkylamines having 5 to 16 carbon atoms, such as monocyclopentylamine, dicyclopentylamine, tricyclopentyl amine, monocyclohexylamine, dicyclohexylamine, monocycloheptylamine, and dicycloheptylamine; monoamines having an alkyl group and a cycloalkyl group, such as dimethyl(cyclopentyl)amine, dimethyl(cyclohexyl)amine, and dimethyl(cycloheptyl) amine; and alkylcycloalkylamines such as (methyl cyclopentyl)amine (all substituted isomers), bis(methyl cyclopentyl) amine (all substituted isomers), (dimethyl cyclopentyl)amine (all substituted isomers), bis(dimethyl cyclopentyl)amine (all substituted isomers), (ethyl cyclopentyl)amine (all substituted isomers), bis(ethyl cyclopentyl)amine (all substituted isomers), (methyl ethyl cyclopentyl)amine (all substituted isomers), bis(methyl ethyl cyclopentyl)amine (all substituted isomers), (diethyl cyclopentyl)amine (all substituted isomers), (methyl cyclohexyl)amine (all substituted isomers), bis(methyl cyclohexyl)amine (all substituted isomers), (dimethyl cyclohexyl)amine (all substituted isomers), bis(dimethyl cyclohexyl)amine (all substituted isomers), (ethyl cyclohexyl)amine (all substituted isomers), bis(ethyl cyclohexyl)amine (all substituted isomers), (methyl ethyl cyclohexyl)amine (all substituted isomers), (diethyl cyclohexyl) amine (all substituted isomers), (methyl cycloheptyl)amine (all substituted isomers), bis(methyl cycloheptyl)amine (all substituted isomers), (dimethyl cycloheptyl)amine (all substituted isomers), (ethyl cycloheptyl)amine (all substituted isomers), (methyl ethyl cycloheptyl)amine (all substituted isomers), and (diethyl cycloheptyl)amine (all substituted isomers). Moreover, the monoamines include monoamines derived from oils and fats, which are typified by beef tallow amine and the like. Specifically, examples of the above-described polyamines include alkylene polyamines, such as ethylene diamine, diethylene triamine, triethylene tetramine, tetraethylene pentamine, pentaethylene hexamine, propylene diamine, dipropylene triamine, tripropylene tetramine, tetrapropylene pentamine, pentapropylene hexamine, butylene diamine, dibutylene triamine, tributylene tetramine, tetrabutylene pentamine, and pentabutylene hexamine; N-alkylethylenediamines, such as N-methyl ethylene diamine, N-ethyl ethylene diamine, N-propyl ethylene diamine (all isomers), N-butyl ethylene diamine (all isomers), N-pentyl ethylene diamine (all isomers), N-hexyl ethylene diamine (all isomers), N-heptyl ethylene diamine (all isomers), N-octyl ethylene diamine (all isomers), N-nonyl ethylene diamine (all isomers), N-decyl ethylene diamine (all isomers), N-undecyl ethylene diamine (all isomers), N-dodecyl ethylene diamine (all isomers), N-tridecyl ethylene diamine (all isomers), N-tetradecyl ethylene diamine (all isomers), N-pentadecyl ethylene diamine (all isomers), N-hexadecyl ethylene diamine (all isomers), N-heptadecyl ethylene diamine (all isomers), N-octadecyl ethylene diamine (all isomers), N-nonadecyl ethylene diamine (all isomers), N-icosyl ethylene diamine (all isomers), N-henicosyl ethylene diamine (all isomers), N-docosyl ethylene diamine (all isomers), and N-tricosyl ethylene diamine (all isomers); N-alkenylethylenediamines such as N-vinyl ethylene diamine, N-propenyl ethylene diamine (all isomers), N-butenyl ethylene diamine (all isomers), N-pentenyl ethylene diamine (all isomers), N-hexenyl ethylene diamine (all isomers), N-heptenyl ethylene diamine (all isomers), N-octenyl ethylene diamine (all isomers), N-nonenyl ethylene diamine (all isomers), N-decenyl ethylene diamine (all isomers), N-undecenyl ethylene diamine (all isomers), N-dodecenyl ethylene diamine (all isomers), N-tridecenyl ethylene diamine (all isomers), N-tetradecenyl ethylene diamine (all isomers), N-pentadecenyl ethylene diamine (all isomers), N-hexadecenyl ethylene diamine (all isomers), N-heptadecenyl ethylene diamine (all isomers), N-octadecenyl ethylene diamine (all isomers), N-nonadecenyl ethylene diamine (all isomers), N-icosenyl ethylene diamine (all isomers), N-henicosenyl ethylene diamine (all isomers), N-docosenyl ethylene diamine (all isomers), and N-tricosenyl ethylene diamine (all isomers); and N-alkyl or N-alkenylalkylenepolyamines such as N-alkyl diethylene triamine, N-alkenyl diethylene triamine, N-alkyl triethylene tetramine, N-alkenyl triethylene tetramine, N-alkyl tetraethylene pentamine, N-alkenyl tetraethylene pentamine, N-alkyl pentaethylene hexamine, N-alkenyl pentaethylene hexamine, N-alkyl propylene diamine, N-alkenyl propylene diamine, N-alkyl dipropylene triamine, N-alkenyl dipropylene triamine, N-alkyl tripropylene tetramine, N-alkenyl tripropylene tetramine, N-alkyl tetrapropylene pentamine, N-alkenyl tetrapropylene pentamine, N-alkyl pentapropylene hexamine, N-alkenyl pentapropylene hexamine, N-alkyl butylene diamine, N-alkenyl butylene diamine, N-alkyl dibutylene triamine, N-alkenyl dibutylene triamine, N-alkyl tributylene tetramine, N-alkenyl tributylene tetramine, N-alkyl tetrabutylene pentamine, N-alkenyl tetrabutylene pentamine, N-alkyl pentabutylene hexamine, and N-alkenyl pentabutylene hexamine. Moreover, the polyamines include polyamines derived from oils and fats, which are typified by beef tallow polyamine and the like. Specifically, examples of the above-described alkanolamines include monomethanolamine, dimethanolamine, trimethanolamine, monoethanolamine, diethanolamine, triethanolamine, mono(n-propanol)amine, di(n-propanol)amine, tri(n-propanol)amine, monoisopropanolamine, diisopropanolamine, triisopropanolamine, monobutanolamine (all isomers), dibutanolamine (all isomers), tributanolamine (all isomers), monopentanolamine (all isomers), dipentanolamine (all isomers), tripentanolamine (all isomers), monohexanolamine (all isomers), dihexanolamine (all isomers), monoheptanolamine (all isomers), diheptanolamine (all isomers), monooctanolamine (all isomers), monononanolamine (all isomers), monodecanolamine (all isomers), monoundecanolamine (all isomers), monododecanolamine (all isomers), monotridecanolamine (all isomers), monotetradecanolamine (all isomers), monopentadecanolamine (all isomers), monohexadecanolamine (all isomers), diethyl monoethanol amine, diethyl monopropanol amine (all isomers), diethyl monobutanol amine (all isomers), diethyl monopentanol amine (all isomers), dipropyl monoethanol amine (all isomers), dipropyl monopropanol amine (all isomers), dipropyl monobutanol amine (all isomers), dipropyl monopentanol amine (all isomers), dibutyl monoethanol amine (all isomers), dibutyl monopropanol amine (all isomers), dibutyl monobutanol amine (all isomers), dibutyl monopentanol amine (all isomers), monoethyl diethanol amine, monoethyl dipropanol amine (all isomers), monoethyl dibutanol amine (all isomers), monoethyl dipentanol amine (all isomers), monopropyl diethanol amine (all isomers), monopropyl dipropanol amine (all isomers), monopropyl dibutanol amine (all isomers), monopropyl dipentanol amine (all isomers), monobutyl diethanol amine (all isomers), monobutyl dipropanol amine (all isomers), monobutyl dibutanol amine (all isomers), and monobutyl dipentanol amine (all isomers). Among the above-described amines, monoamines are preferable because of little impact on a refrigerated system, and among monoamines, in particular, alkylamines, monoamines having an alkyl group and an alkenyl group, monoamines having an alkyl group and a cycloalkyl group, cycloalkylamines, and alkylcycloalkylamines are more preferable. In terms of a stain resistance property, amines having 3 or more carbon atoms in total in an amine molecule are preferable, and amines having 5 or more carbon atoms in total are more preferable.

The content of the fatty acid amine salt is not particularly limited, but is preferably 2 mass % or more, more preferably 2.5 mass % or more, and further preferably 3 mass % or more, and preferably 10 mass % or less, more preferably 9 mass % or less, and further preferably 8 mass % or less, based on the total amount of the composition. When the content of the fatty acid amine salt is less than the above-described lower limit, a water removal property tends to decrease, and when it exceeds the above-described upper limit, a rust preventive property tends to decrease.

Examples of the ester that is the (C) component include (C-1) a partial ester of a polyhydric alcohol, (C-2) an esterified oxidized wax, (C-3) an esterified lanolin fatty acid, and (C-4) an alkyl or alkenyl succinic acid ester.

The (C-1) partial ester of a polyhydric alcohol is an ester in which at least one or more hydroxyl groups in a polyhydric alcohol are not esterified and remain as hydroxyl groups. Any polyhydric alcohols may be used as the polyhydric alcohol that is the raw material of the partial ester, but polyhydric alcohols having preferably 2 to 10, more preferably 3 to 6 hydroxyl groups in the molecule and having 2 to 20, more preferably 3 to 10 carbon atoms are suitably used. Among these polyhydric alcohols, at least one polyhydric alcohol selected from the group consisting of glycerin, trimethylolethane, trimethylolpropane, pentaerythritol, and sorbitan is preferably used, and pentaerythritol is more preferably used.

On the other hand, any carboxylic acids are used as the carboxylic acid which constitutes the partial ester, but the number of carbon atoms of carboxylic acids is preferably 2 to 30, more preferably 6 to 24, and further preferably 10 to 22. The carboxylic acids may be saturated carboxylic acids or unsaturated carboxylic acids, and may be straight-chain carboxylic acids or branched-chain carboxylic acids. Examples of these fatty acids include saturated fatty acids such as acetic acid, propionic acid, butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, henicosanoic acid, docosanoic acid, tricosanoic acid, tetracosanoic acid, pentacosanoic acid, hexacosanoic acid, heptacosanoic acid, octacosanoic acid, nonacosanoic acid, and triacontanoic acid; unsaturated fatty acids such as propenoic acid, budenoic acid, pentenoic acid, hexenoic acid, heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, icosenoic acid, henicosenoic acid, docosenoic acid, tricosenoic acid, tetracosenoic acid, pentacosenoic acid, hexacosenoic acid, heptacosenoic acid, octacosenoic acid, nonacosenoic acid, and triacontenoic acid; and mixtures thereof, and also include all substituted isomers of these fatty acids.

As the carboxylic acid which constitutes the partial ester, hydroxycarboxylic acids may be used. The hydroxycarboxylic acids may be saturated carboxylic acids or unsaturated carboxylic acids, and in terms of stability, saturated carboxylic acids are preferable. The hydroxycarboxylic acids may be straight-chain carboxylic acids or branched carboxylic acids; but straight-chain carboxylic acids, or branched carboxylic acids which have 1 to 3, more preferably 1 to 2, and particularly preferably one branched chain having 1 or 2 carbon atoms, and more preferably one carbon atom, that is, methyl group, are preferable.

In terms of achieving both a rust preventive property and storage stability, the number of carbon atoms of the hydroxycarboxylic acids is preferably 2 to 40, more preferably 6 to 30, and further preferably 8 to 24. The number of carboxylic acid groups in the hydroxycarboxylic acids is not particularly limited; and the hydroxycarboxylic acids may be monobasic acids or polybasic acids, monobasic acids being preferable. The number of hydroxyl groups in the hydroxycarboxylic acids is not particularly limited, but preferably 1 to 4, more preferably 1 to 3, further preferably 1 to 2, and particularly preferably 1, in terms of stability.

Although the binding position of a hydroxyl group in the hydroxycarboxylic acids is arbitrary, carboxylic acids in which a hydroxyl group is bonded to a carbon atom to which a carboxylic acid group is bonded (α-hydroxy acids), or carboxylic acids in which a hydroxyl group is bonded to a carbon atom at the other end of a main chain when viewed from a carbon atom to which a carboxylic acid group is bonded (ω-hydroxy acids) are preferable.

Preferred examples of the hydroxycarboxylic acids include α-hydroxy acid represented by the formula (1) and ω-hydroxy acid represented by the formula (2):

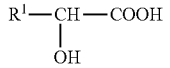

(1)

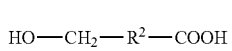

(2)

wherein, $R^1$ represents a hydrogen atom, an alkyl group having 1 to 38 carbon atoms, or an alkenyl group having 2 to 38 carbon atoms, and $R^2$ represents an alkylene group having 1 to 38 carbon atoms or an alkenylene group having 2 to 38 carbon atoms.

Examples of the alkyl group and the alkenyl group represented by $R^1$ include alkyl groups such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an icosyl group, a henicosyl group, a docosyl group, a tricosyl group, a tetracosyl group, a pentacosyl group, a hexacosyl group, a heptacosyl group, an octacosyl group, a nonacosyl group, a triacontyl group, a hentriacontyl group, a dotriacontyl group, a tritriacontyl group, a tetratriacontyl group, a pentatriacontyl group, a hexatriacontyl group, a heptatriacontyl group, and an octatriacontyl group; and alkenyl groups such as an ethenyl group (a vinyl group), a propenyl group (an allyl group), a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an icosenyl group, a henicosenyl group, a docosenyl group, a tricosenyl group, a tetracosenyl group, a pentacosenyl group, a hexacosenyl group, a heptacosenyl group, an octacosenyl group, a nonacosenyl group, a triacontenyl group, a hentriacontenyl group, a dotriacontenyl group, a tritriacontenyl group, a tetratriacontenyl group, a pentatriacontenyl group, a hexatriacontenyl group, a heptatriacontenyl group, and an octatriacontenyl group, and also include all isomers thereof.

Examples of the alkylene group and the alkenylene group represented by $R^2$ include alkylene groups such as a methylene group, an ethylene group, a propylene group, a butylene group, a pentylene group, a hexylene group, a heptylene group, an octylene group, a nonylene group, a decylene group, an undecylene group, a dodecylene group, a tridecylene group, a tetradecylene group, a pentadecylene group, a hexadecylene group, a heptadecylene group, an octadecylene group, a nonadecylene group, an icosylene group, a henicosylene group, a docosylene group, a tricosylene group, a tetracosylene group, a pentacosylene group, a hexacosylene group, a heptacosylene group, an octacosylene group, a nonacosylene group, a triacontylene group, a hentriacontylene group, a dotriacontylene group, a tritriacontylene group, a tetratriacontylene group, a pentatriacontylene group, a hexatriacontylene group, a heptatriacontylene group, and an octatriacontylene group; and alkenylene groups such as an ethenylene group (a vinylene group), a propenyl group (an allylene group), a butenylene group, a pentenylene group, a hexenylene group, a heptenylene group, an octenylene group, a nonenylene group, a decenylene group, an undecenylene group, a dodecenylene group, a tridecenylene group, a tetradecenylene group, a pentadecenylene group, a hexadecenylene group, a heptadecenylene group, an octadecenylene group, a nonadecenylene group, an icosenylene group, a henicosenylene group, a docosenylene group, a tricosenylene group, a tetracosenylene group, a pentacosenylene group, a hexacosenylene group, a heptacosenylene group, an octacosenylene group, a nonacosenylene group, a triacontenylene group, a hentriacontenylene group, a dotriacontenylene group, a tritriacontenylene group, a tetratriacontenylene group, a pentatriacontenylene group, a hexatriacontenylene group, a heptatriacontenylene group, and an octatriacontenylene group, and also include all isomers thereof.

As a raw material containing the foregoing hydroxycarboxylic acids, a lanolin fatty acid obtained by refining a waxy material that adheres to sheep wool by hydrolysis or the like may be preferably used. When the hydroxycarboxylic acids are used as a constituent carboxylic acid of the partial ester, carboxylic acids having no hydroxyl group may be used in combination. When the carboxylic acid which constitutes the partial ester contains both hydroxycarboxylic acids and carboxylic acids having no hydroxyl group, the ratio of the hydroxycarboxylic acids to the total amount of the constituent carboxylic acid is preferably 5 to 80 mass %. When the ratio of the hydroxycarboxylic acids is less than 5 mass %, a rust preventive property tends to become insufficient. For the similar reason, the ratio of the hydroxycarboxylic acids is preferably 10 mass % or more, and further preferably 15 mass % or more. Moreover, when the ratio of the hydroxycarboxylic acids exceeds 80 mass %, storage stability and solubility in a base oil tend to become insufficient. For the similar reason, the ratio of the hydroxycarboxylic acids is more preferably 60 mass % or less, further preferably 40 mass % or less, even more preferably 30 mass % or less, and particularly preferably 20 mass % or less.

The carboxylic acids having no hydroxyl group may be saturated carboxylic acids or unsaturated carboxylic acids. Among the carboxylic acids having no hydroxyl group, the saturated carboxylic acids may be straight-chain carboxylic acids or branched carboxylic acids; but straight-chain carboxylic acids, or branched carboxylic acids which have 1 to 3, more preferably 1 to 2, and further preferably one branched chain having 1 or 2 carbon atoms, and more preferably one carbon atom, that is, methyl group, are preferable.

In terms of achieving both a rust preventive property and storage stability, the number of carbon atoms of the saturated carboxylic acids having no hydroxyl group is preferably 2 to 40, more preferably 6 to 30, and further preferably 8 to 24. The number of carboxylic acid groups in the saturated carboxylic acids having no hydroxyl group is not particularly limited; and the saturated carboxylic acids having no hydroxyl group may be monobasic acids or polybasic acids, monobasic acids being preferable. Among the saturated carboxylic acids having no hydroxyl group, in terms of oxidation stability and a stain resistance property, straight-chain saturated carboxylic acids having 10 to 16 carbon atoms, such as lauric acid and stearic acid, are particularly preferable.

Among the carboxylic acids having no hydroxyl group, the unsaturated carboxylic acids may be straight-chain carboxylic acids or branched carboxylic acids; but straight-chain carboxylic acids, or branched carboxylic acids which have 1 to 3, more preferably 1 to 2, and further preferably one branched chain having 1 or 2 carbon atoms, and more preferably one carbon atom are preferable. Among the carboxylic acids having no hydroxyl group, in terms of achieving both a rust preventive property and storage stability, the number of carbon atoms of the unsaturated carboxylic acids is preferably 2 to 40, more preferably 6 to 30, further preferably 8 to 24, and particularly preferably 12 to 22.

The number of carboxylic acid groups in the unsaturated carboxylic acids having no hydroxyl group is not particularly limited; and the unsaturated carboxylic acids having no hydroxyl group may be monobasic acids or polybasic acids, monobasic acids being preferable. Although the number of unsaturated bonds in the unsaturated carboxylic acids having no hydroxyl group is not particularly limited, it is preferably 1 to 4, more preferably 1 to 3, further preferably 1 to 2, and particularly preferably 1, in terms of stability. Among the unsaturated carboxylic acids having no hydroxyl group, in terms of a rust preventive property and solubility in a base oil, straight-chain unsaturated carboxylic acids having 18 to 22 carbon atoms, such as oleic acid, are preferable, and furthermore, in terms of oxidation stability, solubility in a base oil, and a stain resistance property, branched unsaturated carboxylic acids having 18 to 22 carbon atoms, such as isostearic acid, are preferable, oleic acid being particularly preferable.

In the partial ester of a polyhydric alcohol and a carboxylic acid, the ratio of the unsaturated carboxylic acids to the constituent carboxylic acid is preferably 5 to 95 mass %. By making the ratio of the unsaturated carboxylic acids be 5 mass % or more, a rust preventive property and storage stability may be further improved. For the similar reason, the ratio of the unsaturated carboxylic acids is more preferably 10 mass % or more, further preferably 20 mass % or more, even more preferably 30 mass % or more, and particularly preferably 35 mass % or more. On the other hand, when the ratio of the unsaturated carboxylic acids exceeds 95 mass %, an atmospheric exposure property and solubility in a base oil tend to become insufficient. For the similar reason, the ratio of the unsaturated carboxylic acids is more preferably 80 mass % or less, further preferably 60 mass % or less, and particularly preferably 50 mass % or less.

The unsaturated carboxylic acids include both unsaturated carboxylic acids having a hydroxyl group and unsaturated carboxylic acids having no hydroxyl group, and the ratio of the unsaturated carboxylic acids having no hydroxyl group to the total amount of the unsaturated carboxylic acids is preferably 80 mass % or more, more preferably 90 mass % or more, and further preferably 95 mass % or more.

When the above-described partial ester is a partial ester in which the ratio of the unsaturated carboxylic acids to the constituent carboxylic acid is 5 to 95 mass %, the iodine value of the partial ester is preferably 5 to 75, more preferably 10 to 60, and further preferably 20 to 45. When the iodine value of the partial ester is less than 5, a rust preventive property and storage stability tend to decrease. Moreover, when the iodine value of the partial ester exceeds 75, an atmospheric exposure property and solubility in a base oil tend to decrease. The "iodine value" in the present invention means an iodine value measured by Indicator titration method of JIS K 0070 "Acid value, saponification value, iodine value, hydroxyl value, and unsaponifiable matter value of chemical products".

Examples of a manufacturing method of the above-described partial ester include the following manufacturing methods (i), (ii), and (iii).

(i) A method in which a partial ester of a polyhydric alcohol and a hydroxycarboxylic acid, or a mixture of a hydroxycarboxylic acid and a saturated carboxylic acid having no hydroxyl group, and a partial ester of a polyhydric alcohol and an unsaturated carboxylic acid having no hydroxyl group, or a mixture of an unsaturated carboxylic acid having no hydroxyl group and a saturated carboxylic acid having no hydroxyl group, are mixed such that the carboxylic acid composition in a mixture of the two satisfies the above-described conditions.

(ii) A method in which a carboxylic acid having a hydroxyl group and an unsaturated carboxylic acid having no hydroxyl group are mixed, or a saturated carboxylic acid having no hydroxyl group is further mixed, and a partial esterification reaction of the carboxylic acid mixture and a polyhydric alcohol is carried out such that the carboxylic acid composition of a partial ester to be obtainable satisfies the above-described conditions.

(iii) A method in which a partial ester of a polyhydric alcohol and a hydroxycarboxylic acid, or a mixture of a hydroxycarboxylic acid and a saturated carboxylic acid having no hydroxyl group, or a partial ester of a polyhydric alcohol and an unsaturated carboxylic acid having no hydroxyl group, or a mixture of an unsaturated carboxylic acid having no hydroxyl group and a saturated carboxylic acid having no hydroxyl group, is mixed into a partial ester with a mixture of a hydroxycarboxylic acid and an unsaturated carboxylic acid having no hydroxyl group, or a mixture of these carboxylic acids and a saturated carboxylic acid having no hydroxyl group such that the carboxylic acid composition satisfies the above-described conditions.

In the case of the above-described manufacturing method (i), for example, as the mixture of a hydroxycarboxylic acid and a saturated carboxylic acid having no hydroxyl group, a lanolin fatty acid may be preferably used, and as the unsaturated carboxylic acid having no hydroxyl group, an unsaturated carboxylic acid having 2 to 40 carbon atoms such as oleic acid may be preferably used. In this case, the content ratio of the partial ester (first partial ester) composed of a polyhydric alcohol and the mixture of a hydroxycarboxylic acid and a saturated carboxylic acid having no hydroxyl group, preferably a lanolin fatty acid, to the partial ester (second partial ester) composed of a polyhydric alcohol and the unsaturated carboxylic acid having no hydroxyl group, preferably oleic acid, is not particularly limited as long as the carboxylic acid composition ratio in the mixture of the two satisfies the above-described conditions, but the ratio of the first partial ester to the total amount of the first and second partial esters is preferably 20 to 95 mass %, more preferably 40 to 80 mass %, and particularly preferably 55 to 65 mass %. When the ratio of the first partial ester is less than 20 mass % or exceeds 95 mass %, a rust preventive property such as an atmospheric exposure property tends to become insufficient. Furthermore, when the ratio of the first partial ester exceeds 95 mass %, solubility of the entire partial ester in a base oil decreases, and storage stability tends to become insufficient.

The (C-2) esterified oxidized wax refers to one obtained by reacting an oxidized wax with alcohols and esterifying a part or all of acidic groups in the oxidized wax. Examples of the oxidized wax used as a raw material for the esterified oxidized wax include oxidized waxes; and examples of the alcohols used as a raw material for the esterified oxidized wax include straight-chain or branched saturated monohydric alcohols having 1 to 20 carbon atoms, straight-chain or branched unsaturated monohydric alcohols having 1 to 20 carbon atoms, the polyhydric alcohols exemplified in the explanation of the above-described esters, and an alcohol obtained by hydrolysis of lanolin.

The (C-3) esterified lanolin fatty acid indicates one obtained by reacting a lanolin fatty acid obtained by refining, such as hydrolysis, of a waxy material that adheres to sheep wool, with alcohols. Examples of the alcohols used as a raw material for the esterified lanolin fatty acid include the alcohols exemplified in the explanation of the above-described esterified oxidized wax, and among them, polyhydric alcohols are preferable, and trimethylolpropane, trimethylolethane, sorbitan, pentaerythritol, and glycerin are more preferable. Examples of the above-described alkyl or alkenyl succinic acid ester include esters of the above-described alkyl or alkenyl succinic acid and a monohydric alcohol or a dihydric or higher polyhydric alcohol. Among them, esters of a monohydric alcohol or a dihydric alcohol are preferable.

The monohydric alcohol may be straight-chain or branched-chain, and may be saturated alcohols or unsaturated alcohols. The number of carbon atoms of the monohydric alcohol is not particularly limited, but aliphatic alcohols having 8 to 18 carbon atoms are preferable. As the dihydric alcohol, alkylene glycols and polyoxyalkylene glycols are preferably used. Examples of the alkylene glycols include ethylene glycol, propylene glycol, butylene glycol, pentylene glycol, hexylene glycol, heptylene glycol, octylene glycol, nonylene glycol, and decylene glycol.

Examples of the polyoxyalkylene glycols include one obtained by homopolymerization or copolymerization of ethylene oxide, propylene oxide, and butylene oxide. When alkylene oxides having different structures are copolymerized in a polyoxyalkylene glycol, the form of polymerization of oxyalkylene groups is not particularly limited, and it may be a random copolymerization or a block copolymerization. The polymerization degree of the polyoxyalkylene glycol is not particularly limited, but is preferably 2 to 10, more preferably 2 to 8, and further preferably 2 to 6.

The (C-4) alkyl or alkenyl succinic acid ester may be diesters (complete esters) in which both of two carboxyl groups in alkyl or alkenyl succinic acid are esterified, or monoesters (partial esters) in which only one of carboxyl groups is esterified, and in terms of a better rust preventive property, the monoesters are preferable. Among these esters, in terms of exhibiting a better rust preventive property, the use of partial esters of polyhydric alcohols is particularly preferable, and specifically, examples thereof include pentaerythritol ester of lanolin, sorbitan monooleate, and sorbitan isostearate.

The amount of esters added is preferably 4 mass % or more, more preferably 5 mass % or more, and further preferably 6 mass % or more, and preferably 20 mass % or less, more preferably 15 mass % or less, and further preferably 10 mass % or less, based on the total amount of the composition. When it is too little, a sufficient rust preventive property is not obtainable, and when it is too much, life of an oil solution when a large amount of water is mixed is shortened.

The (D) component is at least one rust preventive agent selected from the group consisting of (D-1) a sarcosine-type compound, (D-2) a sulfonic acid salt, (D-3) an amine, (D-4) a carboxylic acid, (D-5) a carboxylic acid salt, (D-6) a paraffin wax, (D-7) an oxidized wax salt, and (D-8) a boron compound.

The (D-1) sarcosine-type compound used in the present embodiment has a structure represented by the following formula (3), (4), or (5):

$$R^3—CO—NR_4—(CH_2)_n—COOX \quad (3)$$

wherein, $R^3$ represents an alkyl group having 6 to 30 carbon atoms or an alkenyl group having 6 to 30 carbon atoms, $R^4$ represents an alkyl group having 1 to 4 carbon atoms, X represents a hydrogen atom, an alkyl group having 1 to 30 carbon atoms, or an alkenyl group having 1 to 30 carbon atoms, and n represents an integer of 1 to 4;

$$[R^3—CO—NR^4—(CH_2)—COO]_mY \quad (4)$$

wherein, $R^3$ represents an alkyl group having 6 to 30 carbon atoms or an alkenyl group having 6 to 30 carbon atoms, $R^4$ represents an alkyl group having 1 to 4 carbon atoms, Y represents an alkali metal or an alkali earth metal, n represents an integer of 1 to 4, and m represents 1 when Y is an alkali metal, and represents 2 when Y is an alkali earth metal;

$$[R^3—CO—NR^4—(CH_2)_n—COO]_m—Z—(OH)_m \quad (5)$$

wherein, $R^3$ represents an alkyl group having 6 to 30 carbon atoms or an alkenyl group having 6 to 30 carbon atoms, $R^4$ represents an alkyl group having 1 to 4 carbon atoms, Z represents a residue other than hydroxyl groups of a dihydric or higher polyhydric alcohol, m represents an integer of 1 or more, m' represents an integer of 0 or more, m+m' represents a valence of Z, and n represents an integer of 1 to 4.

In the formulas (3) to (5), $R^3$ represents an alkyl group having 6 to 30 carbon atoms or an alkenyl group having 6 to 30 carbon atoms. In terms of solubility in a base oil and the like, it is necessary that $R^3$ be an alkyl group or an alkenyl group having 6 or more carbon atoms, and the number of carbon atoms is preferably 7 or more, and more preferably 8 or more. Moreover, in terms of storage stability and the like, it is necessary that $R^3$ be an alkyl group or an alkenyl group having 30 or less carbon atoms, and the number of carbon atoms is preferably 24 or less, and more preferably 20 or less. Specifically, examples of these alkyl groups and alkenyl groups include alkyl groups such as a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, and an icosyl group (these alkyl groups may be straight-chain or branched); and alkenyl groups such as a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, and an icosenyl group (these alkenyl groups may be straight-chain or branched, and the position of a double bond is also arbitrary).

In the formulas (3) to (5), $R^4$ represents an alkyl group having 1 to 4 carbon atoms. In terms of storage stability and the like, it is necessary that $R^4$ be an alkyl group having 4 or less carbon atoms, and the number of carbon atoms is preferably 3 or less, and more preferably 2 or less.

In the formulas (3) to (5), n represents an integer of 1 to 4. In terms of storage stability and the like, it is necessary that n be an integer of 4 or less, n is preferably 3 or less, and n is more preferably 2 or less.

In the formula (3), X represents a hydrogen atom, an alkyl group having 1 to 30 carbon atoms, or an alkenyl group having 1 to 30 carbon atoms. In terms of storage stability and the like, it is necessary that an alkyl group or an alkenyl group represented by X have 30 or less carbon atoms, and the number of carbon atoms is preferably 20 or less, and more preferably 10 or less. Specifically, examples of these alkyl groups and alkenyl groups include alkyl groups such as a methyl group, an ethyl group, a propyl group, a butyl group, a pentyl group, a hexyl group, a heptyl group, an octyl group, a nonyl group, and a decyl group (these alkyl groups may be straight-chain or branched); and alkenyl groups such as an ethenyl group, a propenyl group, a butenyl group, a pentenyl group, a hexenyl group, a heptenyl group, an octenyl group, a nonenyl group, and a decenyl group (these alkenyl groups may be straight-chain or branched, and the position of a double bond is also arbitrary). Moreover, in terms of a better rust preventive property and the like, alkyl groups are preferable. In terms of a better rust preventive property and the like, X is preferably a hydrogen atom, an alkyl group having 1 to 20 carbon atoms, or an alkenyl group having 1 to 20 carbon atoms, more preferably a hydrogen atom or an alkyl group having 1 to 20 carbon atoms, and further more preferably a hydrogen atom or an alkyl group having 1 to 10 carbon atoms.

In the formula (4), Y represents an alkali metal or an alkali earth metal, and specifically, examples thereof include sodium, potassium, magnesium, calcium, and barium. Among them, in terms of a better rust preventive property, alkali earth metals are preferable. It is to be noted that, in the case of barium, safety for human bodies and ecosystems may become insufficient. In the formula (4), m represents 1 when Y is an alkali metal, and represents 2 when Y is an alkali earth metal.

In the formula (5), Z represents a residue other than hydroxyl groups of a dihydric or higher polyhydric alcohol. Specifically, examples of the foregoing polyhydric alcohol include dihydric alcohols such as ethylene glycol, propylene glycol, 1,4-butanediol, 1,2-butanediol, neopentyl glycol, 1,6-hexanediol, 1,2-octanediol, 1,8-octanediol, isoprene glycol, 3-methyl-1,5-pentanediol, sorbite, catechol, resorcin, hydroquinone, bisphenol A, bisphenol F, hydrogenated bisphenol A, hydrogenated bisphenol F, and dimerdiol; trihydric alcohols such as glycerin, 2-(hydroxymethyl)-1,3-propanediol, 1,2,3-butanetriol, 1,2,3-pentanetriol, 2-methyl-1,2,3-propanetriol, 2-methyl-2,3,4-butanetriol, 2-ethyl-1,2,3-butanetriol, 2,3,4-pentanetriol, 2,3,4-hexanetriol, 4-propyl-3,4,5-heptanetriol, 2,4-dimethyl-2,3,4-pentanetriol, 1,2,4-butanetriol, 1,2,4-pentanetriol, trimethylolethane, and trimethylolpropane; tetrahydric alcohols such as pentaerythritol, erythritol, 1,2,3,4-pentanetetrol, 2,3,4,5-hexanetetrol, 1,2,4,5-pentanetetrol, 1,3,4,5-hexanetetrol, diglycerin, and sorbitan; pentahydric alcohols such as adonitol, arabitol, xylitol, and triglycerin; hexahydric alcohols such as dipentaerythritol, sorbitol, mannitol, iditol, inositol, dulcitol, talose, and allose; polyglycerin, and dehydration condensation products thereof.

In the formula (5), m represents an integer of 1 or more, m' represents an integer of 0 or more, and m+m' is the same as the valence of Z. That is, all of hydroxyl groups in a polyhydric alcohol of Z may be substituted or only a part thereof may be substituted.

Among the sarcosines represented by the above formulas (3) to (5), in terms of a better rust preventive property, at least one compound selected from the formulas (3) and (4) is preferable. Moreover, only one compound selected from the formulas (3) to (5) may be used alone, or a mixture of two or more compounds may be used.

The content of the sarcosines represented by the formulas (3) to (5) is not particularly limited, but is preferably 0.05 to 10 mass %, more preferably 0.1 to 7 mass %, and further preferably 0.3 to 5 mass %, based on the total amount of the composition. When the content of the sarcosines is less than the above-described lower limit, a rust preventive property and long-term sustainability thereof tend to become insufficient. Even when the content of the sarcosines exceeds the above-described upper limit, an improving effect of a rust preventive property and long-term sustainability thereof, which meets the content, does not tend to be obtainable.

Preferred examples of the (D-2) sulfonic acid salt include sulfonic acid alkali metal salts, sulfonic acid alkali earth metal salts, and sulfonic acid amine salts. Every sulfonic acid salt has sufficiently-high safety for human bodies and ecosystems, and can be obtained by reacting an alkali metal, an alkali earth metal, or an amine with sulfonic acid.

Examples of the alkali metal which constitutes the sulfonic acid salt include sodium and potassium. Moreover, examples of the alkali earth metal include magnesium, calcium, and barium. Among them, as the alkali metal and the alkali earth metal, sodium, potassium, calcium, and barium are preferable, and calcium is particularly preferable.

In the case where the sulfonic acid salt is amine salts, examples of the amines include monoamines, polyamines, and alkanolamines.

Examples of the monoamines include alkylamines such as monomethylamine, dimethylamine, trimethylamine, monoethylamine, diethylamine, triethylamine, monopropylamine, dipropylamine, tripropylamine, monobutylamine, dibutylamine, tributylamine, monopentylamine, dipentylamine, tripentylamine, monohexylamine, dihexylamine, monoheptylamine, diheptylamine, monooctylamine, dioctylamine, monononylamine, monodecylamine, monoundecylamine, monododecylamine, monotridecylamine, monotetradecylamine, monopentadecylamine, monohexadecylamine, monoheptadecylamine, monooctadecylamine, monononadecylamine, monoicosylamine, monohenicosylamine, monodocosylamine, monotricosylamine, dimethyl(ethyl)amine, dimethyl(propyl)amine, dimethyl(butyl)amine, dimethyl(pentyl)amine, dimethyl(hexyl)amine, dimethyl(heptyl)

amine, dimethyl(octyl)amine, dimethyl(nonyl)amine, dimethyl(decyl)amine, dimethyl(undecyl)amine, dimethyl (dodecyl)amine, dimethyl(tridecyl)amine, dimethyl (tetradecyl)amine, dimethyl(pentadecyl)amine, dimethyl (hexadecyl)amine, dimethyl(heptadecyl)amine, dimethyl (octadecyl)amine, dimethyl(nonadecyl)amine, dimethyl (icosyl)amine, dimethyl(henicosyl)amine, and dimethyl (tricosyl)amine;

alkenylamines such as novinylamine, divinylamine, trivinylamine, monopropenylamine, dipropenylamine, tripropenylamine, monobutenylamine, dibutenylamine, tributenylamine, monopentenylamine, dipentenylamine, tripentenylamine, monohexenylamine, dihexenylamine, monoheptenylamine, diheptenylamine, monooctenylamine, dioctenylamine, monononenylamine, monodecenylamine, monoundecenylamine, monododecenylamine, monotridecenylamine, monotetradecenylamine, monopentadecenylamine, monohexadecenylamine, monoheptadecenylamine, monooctadecenylamine, monononadecenylamine, monoicosenylamine, monohenicosenylamine, monodocosenylamine, and monotricosenylamine;

monoamines having an alkyl group and an alkenyl group, such as dimethyl(vinyl)amine, dimethyl(propenyl)amine, dimethyl(butenyl)amine, dimethyl(pentenyl)amine, dimethyl(hexenyl)amine, dimethyl(heptenyl)amine, dimethyl(octenyl)amine, dimethyl(nonenyl)amine, dimethyl(decenyl) amine, dimethyl(undecenyl)amine, dimethyl(dodecenyl) amine, dimethyl(tridecenyl)amine, dimethyl(tetradecenyl) amine, dimethyl(pentadecenyl)amine, dimethyl (hexadecenyl)amine, dimethyl(heptadecenyl)amine, dimethyl(octadecenyl)amine, dimethyl(nonadecenyl)amine, dimethyl(icosenyl)amine, dimethyl(henicosenyl)amine, and dimethyl(tricosenyl)amine;

aromatic-substituted alkylamines such as monobenzylamine, (1-phenethyl)amine, (2-phenethyl)amine (another name: monophenethylamine), dibenzylamine, bis(1-phenethyl) amine, and bis(2-phenethyl)amine (another name: diphenethylamine);

cycloalkylamines having 5 to 16 carbon atoms, such as monocyclopentylamine, dicyclopentylamine, tricyclopentylamine, monocyclohexylamine, dicyclohexylamine, monocycloheptylamine, and dicycloheptylamine; monoamines having an alkyl group and a cycloalkyl group, such as dimethyl(cyclopentyl)amine, dimethyl(cyclohexyl)amine, and dimethyl(cycloheptyl)amine; and alkylcycloalkylamines such as (methyl cyclopentyl)amine, bis(methyl cyclopentyl)amine, (dimethyl cyclopentyl)amine, bis(dimethyl cyclopentyl)amine, (ethyl cyclopentyl)amine, bis(ethyl cyclopentyl)amine, (methyl ethyl cyclopentyl) amine, bis(methyl ethyl cyclopentyl)amine, (diethyl cyclopentyl)amine, (methyl cyclohexyl)amine, bis(methyl cyclohexyl)amine, (dimethyl cyclohexyl)amine, bis(dimethyl cyclohexyl)amine, (ethyl cyclohexyl)amine, bis(ethyl cyclohexyl)amine, (methyl ethyl cyclohexyl)amine, (diethyl cyclohexyl)amine, (methyl cycloheptyl)amine, bis(methyl cycloheptyl)amine, (dimethyl cycloheptyl)amine, (ethyl cycloheptyl)amine, (methyl ethyl cycloheptyl)amine, and (diethyl cycloheptyl)amine, and also include all substituted isomers of these monoamines. The monoamines described herein include monoamines such as beef tallow amine, which are derived from oils and fats.

Examples of the polyamines include alkylenepolyamines such as ethylene diamine, diethylene triamine, triethylene tetramine, tetraethylene pentamine, pentaethylene hexamine, propylene diamine, dipropylene triamine, tripropylene tetramine, tetrapropylene pentamine, pentapropylene hexamine, butylene diamine, dibutylene triamine, tributylene tetramine, tetrabutylene pentamine, and pentabutylene hexamine;

N-alkylethylenediamines such as N-methyl ethylene diamine, N-ethyl ethylene diamine, N-propyl ethylene diamine, N-butyl ethylene diamine, N-pentyl ethylene diamine, N-hexyl ethylene diamine, N-heptyl ethylene diamine, N-octyl ethylene diamine, N-nonyl ethylene diamine, N-decyl ethylene diamine, N-undecyl ethylene diamine, N-dodecyl ethylene diamine, N-tridecyl ethylene diamine, N-tetradecyl ethylene diamine, N-pentadecyl ethylene diamine, N-hexadecyl ethylene diamine, N-heptadecyl ethylene diamine, N-octadecyl ethylene diamine, N-nonadecyl ethylene diamine, N-icosyl ethylene diamine, N-henicosyl ethylene diamine, N-docosyl ethylene diamine, and N-tricosyl ethylene diamine;

N-alkenylethylenediamines such as N-vinyl ethylene diamine, N-propenyl ethylene diamine, N-butenyl ethylene diamine, N-pentenyl ethylene diamine, N-hexenyl ethylene diamine, N-heptenyl ethylene diamine, N-octenyl ethylene diamine, N-nonenyl ethylene diamine, N-decenyl ethylene diamine, N-undecenyl ethylene diamine, N-dodecenyl ethylene diamine, N-tridecenyl ethylene diamine, N-tetradecenyl ethylene diamine, N-pentadecenyl ethylene diamine, N-hexadecenyl ethylene diamine, N-heptadecenyl ethylene diamine, N-octadecenyl ethylene diamine, N-nonadecenyl ethylene diamine, N-icosenyl ethylene diamine, N-henicosenyl ethylene diamine, N-docosenyl ethylene diamine, and N-tricosenyl ethylene diamine; and N-alkyl or N-alkenylalkylenepolyamines such as N-alkyl diethylene triamine, N-alkenyl diethylene triamine, N-alkyl triethylene tetramine, N-alkenyl triethylene tetramine, N-alkyl tetraethylene pentamine, N-alkenyl tetraethylene pentamine, N-alkyl pentaethylene hexamine, N-alkenyl pentaethylene hexamine, N-alkyl propylene diamine, N-alkenyl propylene diamine, N-alkyl dipropylene triamine, N-alkenyl dipropylene triamine, N-alkyl tripropylene tetramine, N-alkenyl tripropylene tetramine, N-alkyl tetrapropylene pentamine, N-alkenyl tetrapropylene pentamine, N-alkyl pentapropylene hexamine, N-alkenyl pentapropylene hexamine, N-alkyl butylene diamine, N-alkenyl butylene diamine, N-alkyl dibutylene triamine, N-alkenyl dibutylene triamine, N-alkyl tributylene tetramine, N-alkenyl tributylene tetramine, N-alkyl tetrabutylene pentamine, N-alkenyl tetrabutylene pentamine, N-alkyl pentabutylene hexamine, and N-alkenyl pentabutylene hexamine, and also include all substituted isomers of these polyamines. Moreover, the polyamines described herein include polyamines (beef tallow polyamine and the like) which are derived from oils and fats.

Examples of the alkanolamines include monomethanolamine, dimethanolamine, trimethanolamine, monoethanolamine, diethanolamine, triethanolamine, mono(n-propanol) amine, di(n-propanol)amine, tri(n-propanol)amine, monoisopropanolamine, diisopropanolamine, triisopropanolamine, monobutanolamine, dibutanolamine, tributanolamine, monopentanolamine, dipentanolamine, tripentanolamine, monohexanolamine, dihexanolamine, monoheptanolamine, diheptanolamine, monooctanolamine, monononanolamine, monodecanolamine, monoundecanolamine, monododecanolamine, monotridecanolamine, monotetradecanolamine, monopentadecanolamine, monohexadecanolamine, diethyl monoethanol amine, diethyl monopropanol amine, diethyl monobutanol amine, diethyl monopentanol amine, dipropyl monoethanol amine, dipropyl monopropanol amine, dipropyl monobutanol amine, dipropyl monopentanol amine, dibutyl monoethanol amine, dibutyl monopropanol amine, dibutyl monobutanol amine, dibutyl monopentanol amine, monoethyl diethanol amine, monoethyl dipropanol amine, monoethyl dibutanol amine, monoethyl dipentanol amine, monopropyl diethanol amine, monopropyl dipropanol amine, monopropyl dibutanol amine, monopropyl dipentanol amine, monobutyl diethanol amine, monobutyl dipropanol amine, monobutyl dibutanol amine, monobutyl dipentanol amine, monocyclohexyl monoethanol amine, monocyclohexyl diethanol amine, monocyclohexyl monopropanol amine, and monocyclohexyl dipropanol amine, and also include all substituted isomers of these alkanolamines.

As the above-described sulfonic acid, those which are manufactured by a conventional method and well-known may be used. Specifically, general examples thereof include synthetic sulfonic acids such as one obtained by sulfonating an alkyl aromatic compound of lubricant oil distillate of a mineral oil; a petroleum sulfonic acid such as a so-called mahogany acid by-produced when manufacturing white oil; or one obtained by sulfonating an alkylbenzene having a straight-chain or branched-chain alkyl group, which is obtainable by alkylating benzene with a polyolefin by-produced from a manufacturing plant of an alkylbenzene which is to be a raw material for a detergent and the like, and one obtained by sulfonating an alkylnaphthalene such as dinonylnaphthalene.

Among the above-described sulfonic acids, at least one selected from the group consisting of: dialkylnaphthalene sulfonic acids in which the number of carbon atoms in total of two alkyl groups bonded to a naphthalene ring is 14 to 30; dialkylbenzene sulfonic acids in which each of two alkyl groups bonded to a benzene ring is a straight-chain alkyl group or a branched-chain alkyl group having one side-chain methyl group, and the number of carbon atoms in total of the two alkyl groups is 14 to 30; and monoalkylbenzene sulfonic acids in which an alkyl bonded to a benzene ring has 15 or more carbon atoms, is preferably used.

In those in which the number of carbon atoms in total of two alkyl groups bonded to a naphthalene ring is 14 to 30 as the preferred dialkylnaphthalene sulfonic acids, when the number of carbon atoms in total of the two alkyl groups is less than 14, a demulsification property tends to become insufficient, and on the other hand, when it exceeds 30, storage stability of the rust preventive oil composition to be obtained tends to decrease. The two alkyl groups may be straight-chain or branched-chain, respectively. Moreover, although the number of carbon atoms of each of the alkyl groups is not particularly limited as long as the number of carbon atoms in total of the two alkyl groups is 14 to 30, the number of carbon atoms of each of the alkyl groups is preferably 6 to 18.

The preferred dialkylbenzene sulfonic acids are those in which each of two alkyl groups bonded to a benzene ring is a straight-chain alkyl group or a branched-chain alkyl group having one side-chain methyl group, and the number of carbon atoms in total of the two alkyl groups is 14 to 30. Although monoalkylbenzene sulfonic acids having an alkyl group having 15 or more carbon atoms may be suitably used as described below, when using monoalkylbenzene sulfonic acids having an alkyl group having less than 15 carbon atoms, storage stability of the composition tends to decrease. Moreover, also in the case of using alkylbenzene sulfonic acids having three or more alkyl groups, storage stability of the composition tends to decrease.

When the alkyl group bonded to a benzene ring of a dialkylbenzene sulfonic acid is a branched-chain alkyl group having a branched structure other than a side-chain methyl group, for example, a branched-chain alkyl group having a side-chain ethyl group, or the like, or a branched-chain alkyl group having two or more branched structures, for example, a branched-chain alkyl group derived from an oligomer of propylene, or the like, human bodies and ecosystems may be adversely impacted, and furthermore, a rust preventive property tends to become insufficient. Moreover, when the number of carbon atoms in total of the two alkyl groups bonded to a benzene ring of a dialkylbenzene sulfonic acid is less than 14, a demulsification property tends to decrease, and on the other hand, when it exceeds 30, storage stability of the composition tends to decrease. In addition, although the number of carbon atoms of each of the alkyl groups is not particularly limited as long as the number of carbon atoms in total of the two alkyl groups bonded to a benzene ring is 14 to 30, the number of carbon atoms of each of the alkyl groups is preferably 6 to 18.

The preferred monoalkylbenzene sulfonic acids are, as described above, those in which the number of carbon atoms of one alkyl group bonded to a benzene ring is 15 or more. When the number of carbon atoms of the alkyl group bonded to a benzene ring is less than 15, storage stability of the composition to be obtainable tends to decrease. Moreover, the alkyl group bonded to a benzene ring may be straight-chain or branched-chain as long as the number of carbon atoms thereof is 15 or more.

Examples of the sulfonic acid salts obtained by using the above-described raw materials include the following: alkali metal bases such as alkali metal oxides or hydroxides; neutral (normal salt) sulfonates obtained by reacting alkali earth metal bases such as alkali earth metal oxides or hydroxides, or amines such as ammonia, alkylamines, and alkanolamines with sulfonic acid; basic sulfonates obtained by heating the above-described neutral (normal salt) sulfonates and excess alkali metal bases, alkali earth metal bases, or amines in the presence of water; carbonate overbasic (ultrabasic) sulfonates obtained by reacting the above-described neutral (normal salt) sulfonates with alkali metal bases, alkali earth metal bases, or amines in the presence of carbon dioxide gas; borate overbasic (ultrabasic) sulfonates obtained by reacting the above-described neutral (normal salt) sulfonates with alkali metal bases, alkali earth metal bases, or amines and boric acid compounds such as boric acid and anhydrous boric acid, or by reacting the above-described carbonate overbasic (ultrabasic) sulfonates with boric acid compounds such as boric acid and anhydrous boric acid, and mixtures thereof.

In the case where the above-described neutral (normal salt) sulfonates are manufactured, desired sulfonic acid salts may be obtainable by adding, as a reaction accelerator, chlorides of the same alkali metal, alkali earth metal, or amines as the desired sulfonic acid salts, or by adding chlorides of the same alkali metal, alkali earth metal, or amines as the desired sulfonic acid salts after preparing neutral (normal salt) sulfonates of different alkali metal, alkali earth metal, or amines from the desired sulfonates to carry out an exchange reaction. However, since chloride ions are likely to remain in the sulfonic acid salts obtained by these methods, it is preferable that, in the present invention, the sulfonic acid salts obtained by these methods be not used, or sufficient washing treatment such as water washing be carried out for the obtained sulfonic acid salts. Specifically, the chloride concentration in the sulfonic acid salts is preferably made to be 200 mass ppm or less, more preferably 100 mass ppm or less, further preferably 50 mass ppm or less, and particularly preferably 25 mass ppm or less.

As the sulfonic acid salts, at least one selected from the group consisting of dialkylnaphthalene sulfonic acid salts in which the number of carbon atoms in total of two alkyl groups bonded to a naphthalene ring is 14 to 30; dialkylbenzene sulfonic acid salts in which each of two alkyl groups bonded to a benzene ring is a straight-chain alkyl group or a branched-chain alkyl group having one side-chain methyl group, and the number of carbon atoms in total of the two alkyl groups is 14 to 30; and monoalkylbenzene sulfonic acid salts in which the an alkyl bonded to a benzene ring has 15 or more carbon atoms, is preferably used.

In the present embodiment, among the above, one or two or more selected from neutral, basic, and overbasic alkali metal sulfonates and alkali earth metal sulfonates are more preferably used; and neutral or nearly neutral alkali metal sulfonates or alkali earth metal sulfonates having a base value of 0 to 50 mgKOH/g, and preferably 10 to 30 mgKOH/g, and/or (over) basic alkali metal sulfonates or alkali earth metal sulfonates having a base value of 50 to 500 mgKOH/g, and preferably 200 to 400 mgKOH/g are particularly preferably used. Moreover, the mass ratio of the above-described alkali metal sulfonates or alkali earth metal sulfonates having a base value of 0 to 50 mgKOH/g to the alkali metal sulfonates or alkali earth metal sulfonates having a base value of 50 to 500 mgKOH/g (alkali metal sulfonates or alkali earth metal sulfonates having base value of 0 to 50 mgKOH/g/alkali metal sulfonates or alkali earth metal sulfonates having base value of 50 to 500 mgKOH/g) is preferably 0.1 to 30, more preferably 1 to 20, and particularly preferably 1.5 to 15, based on the total amount of the composition.

The base value herein means a base value measured by Hydrochloric acid method in conformity with JIS K 2501 "Petroleum products and lubricants-Determination of neutralization number", Section 6, in the state where generally 30 to 70 mass % of a diluent such as a lubricant base oil is contained.

Among the above-described sulfonic acid salts, amine sulfonates, calcium sulfonate, and barium sulfonate are preferable, and alkylenediamine sulfonates and calcium sulfonate are particularly preferable.

Examples of the (D-3) amine as a rust preventive component include the amines exemplified in the explanation of the above-described sulfonic acid salts. Among the above-described amines, monoamines are preferable because a stain resistance property is good, and among monoamines, alkylamines, monoamines having an alkyl group and an alkenyl group, monoamines having an alkyl group and a cycloalkyl group, cycloalkylamines, and alkylcycloalkylamines are more preferable. Moreover, in terms of a good stain resistance property, amines having 3 or more carbon atoms in total in an amine molecule are preferable, and amines having 5 or more carbon atoms in total in an amine molecule are more preferable.

Any carboxylic acids can be used as the (D-4) carboxylic acid as a rust preventive component, but preferable examples thereof include fatty acids, dicarboxylic acids, hydroxyfatty acids, naphthenic acids, resin acids, oxidized waxes, and lanolin fatty acid. The number of carbon atoms of the above-described fatty acids is not particularly limited, but is preferably 6 to 24, and more preferably 10 to 22. Moreover, the fatty acids may be saturated fatty acids or unsaturated fatty acids, and may be straight-chain fatty acids or branched-chain fatty acids.

Examples of these fatty acids include saturated fatty acids such as hexane acid, heptane acid, octane acid, nonane acid, decane acid, undecane acid, dodecane acid, tridecane acid, tetradecane acid, pentadecane acid, hexadecane acid, heptadecane acid, octadecane acid, nonadecane acid, icosane acid, henicosane acid, docosane acid, tricosane acid, and tetracosane acid; unsaturated fatty acids such as hexene acid, heptene acid, octene acid, nonene acid, decene acid, undecene acid, dodecene acid, tridecene acid, tetradecene acid, pentadecene acid, hexadecene acid, heptadecene acid, octadecene acid, nonadecene acid, icosene acid, henicosene acid, docosene acid, tricosene acid, and tetracosene acid; and mixtures thereof, and also include all substituted isomers of these fatty acids.

As the dicarboxylic acids, preferably, dicarboxylic acids having 2 to 40 carbon atoms, and more preferably, dicarboxylic acids having 5 to 36 carbon atoms are used. Among them, dimer acids obtained by dimerizing unsaturated fatty acids having 6 to 18 carbon atoms, and alkyl or alkenyl succinic acids are preferably used. Examples of the dimer acids include a dimer acid of oleic acid. Moreover, among the alkyl or alkenyl succinic acids, alkenyl succinic acids are preferable, and alkenyl succinic acids having an alkenyl group having 8 to 18 carbon atoms are more preferable.

As the hydroxyfatty acids, hydroxyfatty acids having 6 to 24 carbon atoms are preferably used. Although the number of hydroxy groups in the hydroxyfatty acids may be one or may be more than one, those having 1 to 3 hydroxy groups are preferably used. Examples of these hydroxyfatty acids include recinoleic acid.

The naphthenic acids indicate carboxylic acids in petroleum, in which a —COOH group is bonded to a naphthene ring. The resin acids indicate organic acids present in a free state or as esters in a natural resin. The oxidized waxes are those obtained by oxidizing waxes. Although the waxes used as a raw material are not particularly limited, specifically, examples thereof include paraffin waxes, microcrystalline waxes, and petrolatums obtained when refining petroleum distillate, and polyolefin waxes obtained by synthesis.

The lanolin fatty acid is a carboxylic acid obtained by refining, such as hydrolysis, of a waxy material that adheres to sheep wool.

Among these carboxylic acids, in terms of a rust preventive property, a degreasing property, and storage stability, dicarboxylic acids are preferable, dimer acids are more preferable, and a dimer acid of oleic acid is more preferable.

Examples of the (D-5) carboxylic acid salt as a rust preventive component include alkali metal salts, alkali earth metal salts, and amine salts of the above-described carboxylic acids. Examples of the alkali metal which constitutes the carboxylic acid salt include sodium and potassium, and examples of the alkali earth metal include barium, calcium, and magnesium. Among them, a calcium salt is preferably used. Moreover, examples of the amine include the amines exemplified in the explanation of the amines. In the case of a barium salt, safety for human bodies and ecosystems may become insufficient.

Examples of the (D-6) paraffin wax as a rust preventive component include paraffin waxes, microcrystalline waxes, and petrolatums obtained when refining petroleum distillate, and polyolefin waxes obtained by synthesis.

Although not particularly limited, examples of the oxidized wax used as a raw material for the (D-7) oxidized wax salt include oxidized paraffin waxes produced by oxidizing waxes such as the above-described paraffin waxes.

When the oxidized wax salt is an alkali metal salt, examples of the alkali metal used as a raw material include sodium and potassium. When the oxidized wax salt is an alkali earth metal salt, examples of the alkali earth metal used as a raw material include magnesium, calcium, and barium. When the oxidized wax salt is a heavy metal salt, examples of the heavy metal used as a raw material include zinc and lead. Among them, a calcium salt is preferable. It is to be noted that, in terms of safety for human bodies and ecosystems, the oxidized wax salt is preferably not a barium salt and a heavy metal salt.

Examples of the (D-8) boron compound as a rust preventive component include potassium borate and calcium borate.

In the present embodiment, one of the rust preventive agents of the above-described (D) component may be used alone, or a mixture of two or more of the same type of the rust preventive agents may be used, and furthermore, a mixture of two or more of the different types of the rust preventive agents may be used.

In terms of exhibiting a better rust preventive property, as the rust preventive agents of the (D) component, a sarcosine, a sulfonic acid salt, and a paraffin wax are preferable, and these three types are preferably used in combination.

In addition to the above-described rust preventive agents, alcohols typified by higher aliphatic alcohols; and phosphoric acid derivatives and phosphorous acid derivatives typified by amine salts of phosphoric acid monoesters, phosphoric acid diesters, phosphorous acid esters, phosphoric acid, and phosphorous acid can be contained as a rust preventive agent.

Although not particularly limited, in the case where the rust preventive agent other than the carboxylic acid of the (D) component is used, in terms of a rust preventive property, the content is preferably 0.1 mass % or more, more preferably 0.5 mass % or more, and further preferably 1.0 mass % or more, based on the total amount of the composition. Moreover, in terms of storage stability, the content of the rust preventive agent other than the carboxylic acid of the (D) component is preferably 20 mass % or less, more preferably 15 mass % or less, and further preferably 10 mass % or less, based on the total amount of the composition.

Furthermore, although not particularly limited, in the case where the carboxylic acid of the (D) component is used as a rust preventive agent, in terms of a rust preventive property, the content is preferably 0.01 mass % or more, more preferably 0.03 mass % or more, and further preferably 0.05 mass % or more, based on the total amount of the composition.

When the content of the carboxylic acid is less than the above-described lower limit, a rust preventive property improving effect by the addition may become insufficient. Moreover, the content of the carboxylic acid is preferably 2 mass % or less, more preferably 1.5 mass % or less, and further preferably 1 mass % or less, based on the total amount of the composition. When the content of the carboxylic acid exceeds the above-described upper limit, solubility in a base oil becomes insufficient, and storage stability may decrease.

The kinematic viscosity at 40° C. of the rust preventive oil composition according to the present embodiment is preferably 2 $mm^2/s$ or more, more preferably 2.5 $mm^2/s$ or more, and further preferably 3 $mm^2/s$ or more, and preferably 13 $mm^2/s$ or less, more preferably 8 $mm^2/s$ or less, and further preferably 7 $mm^2/s$ or less. When the kinematic viscosity is less than the above-described lower limit, an oil film cannot be maintained, and thus, problems with a rust preventive property may arise, and when it exceeds the above-described upper limit, a water removal property may decrease.

Although a chlorine bleaching agent is sometimes used for the purpose of decoloration when manufacturing the rust preventive agent that is the (D) component, it is preferable that, in the present embodiment, non-chlorine compounds such as hydrogen peroxide be used as a bleaching agent, or no decoloration treatment be carried out. Moreover, chlorine compounds such as hydrochloric acid are sometimes used in hydrolysis or the like of oils and fats, and in this case, it is preferable that non-chlorine acids or basic compounds be used. Furthermore, the compound to be obtained is preferably subjected to sufficient washing treatment such as water washing.

The chlorine concentration of the rust preventive agent that is the (D) component is not particularly limited as long as properties of the rust preventive oil composition according to the present embodiment are not impaired, but it is preferably 200 mass ppm or less, more preferably 100 mass ppm or less, further preferably 50 mass ppm or less, and particularly preferably 25 mass ppm or less.

The rust preventive oil composition according to the present embodiment may further contain other additive agents as necessary. Specifically, examples thereof include paraffin waxes which have a significant rust preventive property improving effect under exposure to an acidic atmosphere; sulfurized oils and fats, sulfurized esters, long-chain alkylzinc dithiophosphates, phosphoric acid esters such as tricresyl phosphate, oils and fats such as lard, fatty acids, higher alcohols, calcium carbonate, and potassium borate which have significant press moldability improving effect and lubricating property improving effect; phenol-based or amine-based antioxidants for improving antioxidation performance; corrosion inhibitors for improving corrosion preventive performance, such as benzotriazole or a derivative thereof, thiadiazole, and benzothiazole; wetting agents such as diethylene glycol monoalkylether film-forming agents such as acrylic polymers and slack waxes; antifoaming agents such as methylsilicone, fluorosilicone, and polyacrylate, surfactants, and mixtures thereof. It is to be noted that the content of the above-described other additive agents is arbitrary, but the total content of these additive agents is preferably 10 mass % or less based on the total amount of the rust preventive oil composition according to the present embodiment.

The rust preventive oil composition according to the present embodiment does not substantially contain water, is made not to contain water other than moisture that is naturally absorbed, and is used without being diluted with water intentionally.

In the rust preventive oil composition according to the present embodiment, the content of each of barium, zinc, chlorine, and lead is, in terms of element, preferably 1000 mass ppm or less, more preferably 500 mass ppm or less, further preferably 100 mass ppm or less, further more preferably 50 mass ppm or less, even more preferably 10 mass ppm or less, particularly preferably 5 mass ppm or less, and further preferably 1 mass ppm or less, based on the total amount of the composition. When either one of these elements has a content exceeding 1000 mass ppm, safety for environments such as human bodies and ecosystems may become insufficient.

It is to be noted that the content of the element in the present invention indicates a value measured by the following methods. That is, the content means a content (mass ppm) based on the total amount of the composition, measured in conformity with ASTM D 5185-95 in the case of barium, zinc, and lead, and IP "PROPOSED METHOD AK/81 Determination of chlorine Microcoulometry oxidative method" in the case of chlorine. The detection limit of each element in the above-described measuring methods is usually 1 mass ppm.

The rust preventive oil composition according to the present embodiment may achieve all of a rust preventive property, a water removal property, a degreasing property, storage stability, and a washing property in a high level and a balanced manner, and may be suitably used as a rust preventive oil for various metal members. In particular, regarding a rust preventive property, time during which Grade A of rust generation (rust generation of 0%) is maintained in a salt water spray test specified by JIS K 2246 "Rust preventive oils" is 16 hours or more, and non-conventional excellent performance is maintained.

The metal member that is a body to be treated is not particularly limited, and specifically, examples thereof include surface-treated steel sheets such as a cold-rolled steel sheet, a hot-rolled steel sheet, a high-tensile steel sheet, and a zinc-coated steel sheet, which are to be an automobile body or electrical product body, metal sheet materials such as a primitive sheet for tinning, an aluminum alloy sheet, and a magnesium alloy sheet, and furthermore, bearing parts such as a rolling bearing, a tapered rolling bearing, and a needle bearing, construction steel, and precision parts.

Conventional rust preventive oils for the foregoing metal members include intermediate rust preventive oils used during processes such as a working process of metal members, shipping rust preventive oils used to prevent rust during shipping, and washing rust preventive oils used during a washing process for removing foreign bodies before being subjected to press working or for removing foreign bodies before shipment in manufacturers of metal sheets, and the washing and rust preventive oil composition of the present invention can be used for all of these intended purposes.

A method of applying the rust preventive oil composition according to the present embodiment to a body to be treated is not particularly limited, and for example, it may be applied to a metal member by spraying, dropping, transfer with a felt material or the like, electrostatic oiling and the like. Among these applying methods, the spraying method is preferable because an oil film thickness can be made uniform by application with fine mist. A coating applicator when using the spraying method is not particularly limited as long as the rust preventive oil composition according to the present embodiment may be atomized, and for example, any of an air spray type, an airless spray type, and a hot-melt type may be used. In the application process, after applying the excess washing and rust preventive oil composition, a step of draining using a centrifugal separator, or a step of draining by being left for long periods of time is preferably provided.

In the case where the rust preventive oil composition according to the present embodiment is used as a wash oil, a large excessive amount of the rust preventive oil composition according to the present embodiment is supplied to the surface of the metal member by spraying, showering, immersion application or the like so that good water removal and subsequent rust prevention may be carried out. Furthermore, by also carrying out surface cleaning using a roll brush or the like after the above-described metal working process as necessary, efficiency of removing foreign bodies can be increased.

When carrying out washing using the rust preventive oil composition according to the present embodiment, the amount of the oil attached to the surface of the metal member is preferably adjusted by also carrying out surface treatment of the metal member using a ringer roll or the like.

In every case of the above-described applying methods of the rust preventive oil composition according to the present embodiment, an excessive amount of the washing and rust preventive oil composition that has been applied to the metal member is preferably recovered, circulated, and reused. In addition, it is preferable that, when circulating the rust preventive oil composition according to the present embodiment, removal of foreign bodies mixed in a circulating system be also carried out. For example, the removal of foreign bodies may be carried out by providing a filter in a circulation pathway of the rust preventive oil composition according to the present embodiment, and preferably shortly before spraying the rust preventive oil composition according to the present embodiment toward the metal member. Moreover, by providing a magnet at the bottom of a tank that stores the rust preventive oil composition according to the present embodiment, foreign bodies such as abrasion powder can be absorbed by magnetic force to be removed.

Performance of the rust preventive oil composition reused in such a process may be decreased due to mixing of a preceding process oil or the like. Therefore, it is preferable that, when reusing the rust preventive oil composition according to the present embodiment, periodic measurement of the kinematic viscosity and the density of an oil to be used, a copper corrosion test, a rust preventive property test and the like be carried out to manage the properties, and oil change, drain disposal, tank cleaning, an oil purifying operation and the like be carried out as necessary.

Regarding a disposed oil solution, the oil solution is used directly, or with being diluted with a solvent or a low-viscosity base oil, in a line whose required performance for the washing and rust preventive oil composition is lower than a line used before disposal so that the total amount of the oil used may be decreased. When the rust preventive oil composition according to the present embodiment is stored in a tank, it is preferably supplied depending on the amount of the composition reduced in the tank. In this case, not always the same composition as the composition that is filled initially, but a composition in which an additive agent for eliciting performance to be enhanced is increased or the like may be supplied on a moment-to-moment basis. Alternatively, a composition whose viscosity is decreased by a method of reducing the content of a high-viscosity base oil or the like may be supplied to maintain washing capacity of the washing and rust preventive oil composition.

When the rust preventive oil composition according to the present embodiment is used in a washing process for removing foreign bodies before shipment in a manufacturer of metal sheets, metal sheets may be shipped by being wound in a coil immediately after the washing process or being stacked as sheet materials. This method has the advantage in that the amount of foreign bodies attached is small and washing may be easily and surely carried out even when carrying out the washing process with the washing rust preventive oil shortly before a press process in press working. It should be understood that rust preventive treatment may be carried out in two stages by providing a process of applying a rust preventive oil again after a washing process with a washing rust preventive oil at a steel sheet manufacturing place.

EXAMPLES

Hereinafter, the present invention will be described in further detail with reference to examples and comparative examples, but the present invention is not limited to the following examples.

Examples 1 to 42, Comparative Examples 1 to 15

In Examples 1 to 42 and Comparative Examples 1 to 15, rust preventive oil compositions having compositions shown in Tables 1 to 6 were prepared, respectively, using components shown below.

(A) Component

A1: a mineral oil having a kinematic viscosity at 40° C. of 0.9 $mm^2/s$ (aromatic component: 0.1 mass % or less)

A2: a mineral oil having a kinematic viscosity at 40° C. of 1.6 $mm^2/s$ (aromatic component: 0.1 mass % or less)

A3: a mineral oil having a kinematic viscosity at 40° C. of 1.9 $mm^2/s$ (aromatic component: 4.8 mass % or less)

A4: a mineral oil having a kinematic viscosity at 40° C. of 8.4 $mm^2/s$

A5: a mineral oil having a kinematic viscosity at 40° C. of 23 $mm^2/s$

A6: a mineral oil having a kinematic viscosity at 40° C. of 68 $mm^2/s$

A7: a mineral oil having a kinematic viscosity at 40° C. of 195 $mm^2/s$

A8: a mineral oil having a kinematic viscosity at 40° C. of 461 $mm^2/s$

A9: a mineral oil having a kinematic viscosity at 40° C. of 586 $mm^2/s$ (B) Component B1: C8 alkylamine salt of C8 fatty acid B2: C18 alkylamine salt of C8 fatty acid B3: C8 alkylamine salt of C18 fatty acid B4: C18 alkylamine salt of C18 fatty acid (C) Component C1: lanolin fatty acid partial ester of pentaerythritol C2: sorbitan monoisostearate C3: sorbitan monooleate C4: trimethylolpropane monooleate (D) Component D1: oleoyl sarcosine (N-Methyloleamidoacetic acid)

D2: ethylenediamine sulfonate

D3: basic Ca sulfonate (base value: 95 mgKOH/g)

D4: paraffin wax

Next, for the respective rust preventive oil compositions of Examples 1 to 42 and Comparative Examples 1 to 15, the following evaluation tests were carried out.

<Rust Preventive Property Test, Water Removal Property Evaluation>

The evaluation was carried out in conformity with a neutral salt water spray test of JIS K 2246 "Rust preventive oils". It is to be noted that polishing of a test piece was carried out in conformity with a water displacement test method of JIS K 2246 "Rust preventive oils", using A, P100 abrasive. Before carrying out the test, the test piece was immersed in tap water for 5 minutes in advance with being kept in a horizontal position, immediately after that, was immersed in a rust preventive oil for 5 seconds with being kept in a horizontal position, and then, was taken out with being kept in a horizontal position and was left to stand for 3 hours in a constant temperature and humidity bath at 50° C. and 95%. After that, the neutral salt water spray test was carried out in conformity with the test method. Time (h) until rust was generated was measured and evaluated, and the evaluation was carried out each predetermined time (16, 24, 36, 48 hours). The evaluation was carried out with the test number of 3, based on JIS Act. The obtained results are shown in Tables 1 to 6.

It is to be noted that one in which stability of an oil solution was poor and separation was observed was subjected to the test after being sufficiently stirred.

If water removal performance is insufficient, rust due to water is generated, and thus, in the present evaluation, a water removal property can be evaluated in addition to a rust preventive property of the oil solution itself.

<Life Test>

1 L of ion-exchange water was added to 1 L of an oil solution to be stirred for 10 hours in a 5 L beaker with intensity for suspending the whole (first day). After that, it was left to stand, and the following day, the same operation was carried out. This was repeated 10 times. On the first day, third day, fifth day, and tenth day, after the stirring, an oil layer was separated to be used as a test oil, and a neutral salt water spray test of JIS K 2246 was carried out and a degree of a decrease in rust preventive performance was compared. The evaluation of a rust preventive property was evaluated by observing a state of a test piece after 24 hours. The obtained results are shown in Tables 1 to 6.

<Stability Test>

After preparing a rust preventive oil composition, it was held in a constant temperature bath adjusted to 45° C. for 240 hours, and the presence or absence of separation of an oil solution was visually evaluated. Lack of separation was indicated by "Absence", and separation was indicated by "Presence". The obtained results are shown in Tables 1 to 6.

<Kinematic Viscosity>

The kinematic viscosity at 40° C. of the rust preventive oil composition was measured in conformity with JIS K 2283. The obtained results are shown in Tables 1 to 6.

TABLE 1

| | | Example | | | | | | | | | |
|---|---|---|---|---|---|---|---|---|---|---|---|
| | | 1 | 2 | 3 | 4 | 5 | 6 | 7 | 8 | 9 | 10 |
| Composition, mass % | A1 | | | | | | | | | | |
| | A2 | 65 | 77 | 60 | 60 | 70 | 88 | 60 | 70 | 50 | 65 |
| | A3 | | | | | | | | | | |
| | A4 | | | | | | | | | | |
| | A5 | | | | 15 | | | | 18 | 10 | |
| | A6 | | | | | 10 | | | | | |
| | A7 | | | | | | | | | | |
| | A8 | 15 | 3 | 20 | 5 | 5 | 5 | 5 | 5 | 5 | 15 |
| | A9 | | | | | | | | | | |
| | High-Viscosity Base Oil/Entire Base Oil, [mass %] | 18.8 | 3.8 | 25.0 | 6.3 | 5.9 | 5.4 | 7.7 | 5.4 | 7.7 | 18.8 |
| | B1 | 5 | 5 | 5 | 5 | 5 | 2 | 15 | 2 | 15 | |
| | B2 | | | | | | | | | | 5 |
| | B3 | | | | | | | | | | |
| | B4 | | | | | | | | | | |
| | C1 | 5 | 5 | 5 | 5 | 5 | 2 | 8 | 2 | 8 | 5 |
| | C2 | 3 | 3 | 3 | 3 | 3 | 1 | 4 | 1 | 4 | 3 |
| | C3 | | | | | | | | | | |
| | C4 | | | | | | | | | | |
| | D1 | 3 | 3 | 3 | 3 | 1 | 1 | 5 | 1 | 5 | 3 |
| | D2 | 4 | 4 | 4 | 4 | 1 | 1 | 3 | 1 | 3 | 4 |
| | D3 | | | | | | | | | | |
| | D4 | | | | | | | | | | |

TABLE 1-continued

| | | Example | | | | | | | | | |
|---|---|---|---|---|---|---|---|---|---|---|---|
| | | 1 | 2 | 3 | 4 | 5 | 6 | 7 | 8 | 9 | 10 |
| | Rust Preventive Property Test | | | | | | | | | | |
| Evaluation Result | 16 h | AAA | AAA | AAA | AAA | AAA | AAA | AAA | AAA | AAA | AAA |
| | 24 h | AAA | AAA | AAA | AAA | AAA | AAA | AAA | AAA | AAA | AAA |
| | 36 h | ABB | ABB | AAB | AAA | AAA | BBB | ABB | AAA | ABB | BBB |
| | 48 h | BBC | BBC | BBC | BBB | BBB | BBC | BBC | BBC | BBC | BBC |
| | Life Test | | | | | | | | | | |
| | 1st Day | AAA | AAA | AAA | AAA | AAA | AAA | AAA | AAA | AAA | AAA |
| | 3rd Day | AAA | AAB | AAB | AAA | AAA | AAA | AAA | AAA | AAA | AAA |
| | 5th Day | BBB | BBB | BBB | AAB | ABB | BBB | BBB | ABB | AAB | BBB |
| | 10th Day | BCC | BCC | BCC | ABB | ABB | BCC | BCC | BCC | BBC | BCC |
| | Stability Test | Absence | Absence | Absence | Absence | Absence | Absence | Absence | Absence | Absence | Absence |
| | Kinematic Viscosity at 40° C., [$mm^2/s$] | 5.02 | 3.26 | 6.96 | 5.05 | 3.75 | 3.01 | 6.98 | 3.45 | 9.50 | 5.04 |

TABLE 2

| | | Example | | | | | | | | | |
|---|---|---|---|---|---|---|---|---|---|---|---|
| | | 11 | 12 | 13 | 14 | 15 | 16 | 17 | 18 | 19 | 20 |
| Composition, mass % | A1 | | | | | | | | | | |
| | A2 | 65 | 65 | 65 | 65 | 65 | 65 | 65 | 65 | 65 | 65 |
| | A3 | | | | | | | | | | |
| | A4 | | | | | | | | | | |
| | A5 | | | | | | | | | | |
| | A6 | | | | | | | | | | |
| | A7 | | | | | | | | | | |
| | A8 | 15 | 15 | 12 | 17 | 18 | 10 | 15 | 15 | 15 | 15 |
| | A9 | | | | | | | | | | |
| | High-Viscosity Base Oil/Entire Base Oil, [mass %] | 18.8 | 18.8 | 15.6 | 20.7 | 21.7 | 13.3 | 18.8 | 18.8 | 18.8 | 18.8 |
| | B1 | | | 8 | 3 | 2 | 10 | 5 | 5 | 5 | 5 |
| | B2 | | | | | | | | | | |
| | B3 | 5 | | | | | | | | | |
| | B4 | | 5 | | | | | | | | |
| | C1 | 5 | 5 | 5 | 5 | 5 | 5 | 8 | | | |
| | C2 | 3 | 3 | 3 | 3 | 3 | 3 | | 8 | | |
| | C3 | | | | | | | | | 8 | |
| | C4 | | | | | | | | | | 8 |
| | D1 | 3 | 3 | 3 | 3 | 3 | 3 | 3 | 3 | 3 | 3 |
| | D2 | 4 | 4 | 4 | 4 | 4 | 4 | 4 | 4 | 4 | 4 |
| | D3 | | | | | | | | | | |
| | D4 | | | | | | | | | | |
| | Rust Preventive Property Test | | | | | | | | | | |
| Evaluation Result | 16 h | AAA | AAA | AAA | AAA | AAA | AAA | AAA | AAA | AAA | AAA |
| | 24 h | AAA | AAA | AAA | AAA | AAA | AAA | AAA | AAA | AAA | AAA |
| | 36 h | BBC | BBB | ABB | ABB | AAB | ABB | AAB | ABB | AAB | ABB |
| | 48 h | BCC | BBC | BBC | BCC | BBC | CCC | BBC | BBC | BBC | BBC |
| | Life Test | | | | | | | | | | |
| | 1st Day | AAA | AAA | AAA | AAA | AAA | AAA | AAA | AAA | AAA | AAA |
| | 3rd Day | AAA | AAA | AAA | AAA | AAA | AAA | AAA | AAA | AAA | AAA |
| | 5th Day | BBB | BBC | AAA | BBC | AAA | BBC | BBB | BBC | ABB | BBB |
| | 10th Day | BCC | BCC | BBC | CCC | BBB | CCC | BCC | BCC | BCC | BCC |
| | Stability Test | Absence | Absence | Absence | Absence | Absence | Absence | Absence | Absence | Absence | Absence |
| | Kinematic Viscosity at 40° C., [$mm^2/s$] | 5.03 | 5.05 | 5.22 | 4.98 | 4.94 | 5.18 | 5.16 | 5.15 | 5.16 | 5.13 |

TABLE 3

| | | Example | | | | | | | | | |
|---|---|---|---|---|---|---|---|---|---|---|---|
| | | 21 | 22 | 23 | 24 | 25 | 26 | 27 | 28 | 29 | 30 |
| Composi-tion, mass % | A1 | | | | | | | | | | |
| | A2 | 65 | 65 | 70 | 62 | 65 | 65 | 65 | 66 | | 66 |
| | A3 | | | | | | | | | 65 | |
| | A4 | | | | | | | | | | |
| | A5 | | | | | | | | | | |
| | A6 | | | | | | | | | | |
| | A7 | | | | | | | | | | |
| | A8 | 17 | 21 | 19 | 11 | 15 | 15 | 15 | | 15 | |
| | A9 | | | | | | | | 14 | | 14 |
| | High-Viscosity Base Oil/Entire Base Oil, [mass %] | 20.7 | 24.4 | 21.3 | 15.1 | 18.8 | 18.8 | 18.8 | 17.5 | 18.8 | 17.5 |
| | B1 | 5 | | | | | | | 5 | 5 | 5 |
| | B2 | | | | | | | | | | |
| | B3 | | | | | 5 | 5 | 5 | | | |
| | B4 | | | | | | | | | | |
| | C1 | 6 | 10 | 4 | 20 | 5 | 5 | 5 | 5 | 5 | 5 |
| | C2 | | | | | 3 | 3 | 3 | 3 | 3 | 3 |
| | C3 | | | | | | | | | | |
| | C4 | | | | | | | | | | |
| | D1 | 3 | 1 | 3 | 3 | 1 | 1 | 7 | 1 | 3 | 3 |
| | D2 | 4 | 3 | 4 | 4 | | | | 6 | 4 | 4 |
| | D3 | | | | | 6 | | | | | |
| | D4 | | | | | | 6 | | | | |
| | Rust Preventive Property Test | | | | | | | | | | |
| Evaluation Result | 16 h | AAA | AAA | AAA | AAA | AAA | AAA | AAA | AAA | AAA | AAA |
| | 24 h | AAA | AAA | AAA | AAA | AAA | AAA | AAA | AAA | AAA | AAA |
| | 36 h | BBB | AAB | BCC | AAA | BBB | ABB | AAB | ABB | ABB | ABB |
| | 48 h | BCC | ABB | CCC | AAB | BBC | BCC | BBC | BBC | BCC | BBB |
| | Life Test | | | | | | | | | | |
| | 1st Day | AAA | AAA | AAA | AAA | AAA | AAA | AAA | AAA | AAA | AAA |
| | 3rd Day | AAA | AAA | AAA | AAA | AAA | AAA | AAA | AAA | AAA | AAA |
| | 5th Day | AAB | BBB | AAB | BCC | ABB | BBC | BBC | BBB | CCC | BCC |
| | 10th Day | BBB | CCC | ABB | CCC | BCC | BCC | BCC | BCC | CCD | CCC |
| | Stability Test | Absence | Absence | Absence | Absence | Absence | Absence | Absence | Absence | Absence | Absence |
| | Kinematic Viscosity at 40° C., [$mm^2/s$] | 5.08 | 4.95 | 5.02 | 5.33 | 5.14 | 5.16 | 5.13 | 4.88 | 6.14 | 4.87 |

TABLE 4

| | | Example | | | | | | | | | |
|---|---|---|---|---|---|---|---|---|---|---|---|
| | | 31 | 32 | 33 | 34 | 35 | 36 | 37 | 38 | 39 | 40 |
| Composi-tion, mass % | A1 | | | | | | | | 65 | | 70 |
| | A2 | 77 | 60 | 79 | 45 | 60 | 77 | 55 | | 46 | |
| | A3 | | | | | | | | | | |
| | A4 | | | | | | | | | | |
| | A5 | | | | | | | | | | |
| | A6 | | | | | | | | | | |
| | A7 | | | | | | | | | | |
| | A8 | 3 | 20 | 1 | 35 | | 3 | | 15 | | 10 |
| | A9 | | | | | 20 | | 25 | | 34 | |
| | High-Viscosity Base Oil/Entire Base Oil, [mass %] | 3.8 | 25.0 | 1.3 | 43.8 | 25.0 | 3.8 | 31.3 | 18.8 | 42.5 | 12.5 |
| | B1 | 5 | 5 | 5 | 5 | 5 | 5 | 5 | 5 | 5 | 5 |
| | B2 | | | | | | | | | | |
| | B3 | | | | | | | | | | |
| | B4 | | | | | | | | | | |
| | C1 | 5 | 5 | 5 | 5 | 5 | 5 | 5 | 5 | 5 | 5 |
| | C2 | 3 | 3 | 3 | 3 | 3 | 3 | 3 | 3 | 3 | 3 |
| | C3 | | | | | | | | | | |
| | C4 | | | | | | | | | | |
| | D1 | 3 | 3 | 3 | 3 | 3 | 3 | 3 | 3 | 3 | 3 |

TABLE 4-continued

| | | Example | | | | | | | | | |
|---|---|---|---|---|---|---|---|---|---|---|---|
| | | 31 | 32 | 33 | 34 | 35 | 36 | 37 | 38 | 39 | 40 |
| | D2 | 4 | 4 | 4 | 4 | 4 | 4 | 4 | 4 | 4 | 4 |
| | D3 | | | | | | | | | | |
| | D4 | | | | | | | | | | |
| | Rust Preventive Property Test | | | | | | | | | | |
| Evaluation Result | 16 h | AAA | AAA | AAA | AAA | AAA | AAA | AAA | AAA | AAA | AAA |
| | 24 h | AAA | AAA | AAA | AAA | AAA | AAA | AAA | AAA | AAA | AAA |
| | 36 h | BBB | AAB | BBB | BBC | ABB | ABB | BBB | BBC | BCC | BCC |
| | 48 h | BCC | ABC | CCC | CCC | BBC | BBC | BBC | BBC | CCC | CCC |
| | Life Test | | | | | | | | | | |
| | 1st Day | AAA | AAA | AAA | AAA | AAA | AAA | AAA | AAA | AAA | AAA |
| | 3rd Day | AAA | AAA | AAA | AAA | AAA | AAA | AAA | AAA | AAA | AAA |
| | 5th Day | ABB | BBB | AAC | BBC | ABB | BBB | BBB | BBB | BBC | CCC |
| | 10th Day | BBC | CCC | ABC | CCC | BBC | BCC | BBC | BCC | BCC | CCD |
| | Stability Test | Absence | Absence | Absence | Absence | Absence | Absence | Absence | Absence | Absence | Absence |
| | Kinematic Viscosity at 40° C., [$mm^2/s$] | 3.25 | 6.14 | 3.03 | 12.6 | 6.46 | 3.13 | 7.95 | 2.53 | 12.7 | 2.04 |

TABLE 5

| | | Example | | Comparative Example | | | | | | | |
|---|---|---|---|---|---|---|---|---|---|---|---|
| | | 41 | 42 | 1 | 2 | 3 | 4 | 5 | 6 | 7 | 8 |
| Composition, mass % | A1 | | 75 | | | | | | | | |
| | A2 | 45 | | 80 | | | 60 | | 69 | 57 | 71 |
| | A3 | | | | | | | | | | |
| | A4 | | | | | | | | | | |
| | A5 | | | | 80 | | 20 | 72 | | | |
| | A6 | | | | | | | | | | |
| | A7 | | | | | | | | | | |
| | A8 | | 5 | | | 80 | | 8 | 15 | 15 | 15 |
| | A9 | 35 | | | | | | | | | |
| | High-Viscosity Base Oil/Entire Base Oil, [mass %] | 43.8 | 6.3 | 0 | 0 | 100 | 0 | 10 | 17.9 | 20.8 | 17.4 |
| | B1 | 5 | 5 | 5 | 5 | 5 | 5 | 5 | 1 | 13 | 5 |
| | B2 | | | | | | | | | | |
| | B3 | | | | | | | | | | |
| | B4 | | | | | | | | | | |
| | C1 | 5 | 5 | 5 | 5 | 5 | 5 | 5 | 5 | 5 | 1 |
| | C2 | 3 | 3 | 3 | 3 | 3 | 3 | 3 | 3 | 3 | 1 |
| | C3 | | | | | | | | | | |
| | C4 | | | | | | | | | | |
| | D1 | 3 | 3 | 3 | 3 | 3 | 3 | 3 | 3 | 3 | 3 |
| | D2 | 4 | 4 | 4 | 4 | 4 | 4 | 4 | 4 | 4 | 4 |
| | D3 | | | | | | | | | | |
| | D4 | | | | | | | | | | |
| | Rust Preventive Property Test | | | | | | | | | | |
| Evaluation Result | 16 h | AAA | AAA | CDD | ABB | ABB | BBB | AAA | AAB | ABB | AAB |
| | 24 h | AAA | AAA | EEE | BBB | ABB | BBC | AAB | ABB | BBB | BBB |
| | 36 h | CCD | CDD | EEE | BBC | BCC | CCC | BBB | BBC | ABB | BBB |
| | 48 h | DDD | DDE | EEE | CDD | CCC | CDD | BBC | CCC | BBB | BCC |
| | Life Test | | | | | | | | | | |
| | 1st Day | AAA | AAA | EEE | BBC | BCC | CCC | BBB | BBC | ABB | AAB |
| | 3rd Day | AAA | AAA | EEE | CCD | CCD | CCD | BBC | CDD | ABB | AAB |
| | 5th Day | CDD | CCD | EEE | CDD | CCD | CCD | BBC | DDD | BBB | BBB |
| | 10th Day | DDE | DDD | EEE | DDE | CDO | DDD | BCC | DDE | BBC | CCC |
| | Stability Test | Absence | Absence | Absence | Absence | Presence | Absence | Absence | Absence | Absence | Absence |
| | Kinematic Viscosity at 40° C., [$mm^2/s$] | 13.4 | 1.78 | 3.03 | 45.3 | 703 | 4.73 | 57.21 | 4.14 | 7.32 | 3.76 |

TABLE 6

| | | Comparative Example | | | | | | |
|---|---|---|---|---|---|---|---|---|
| | | 9 | 10 | 11 | 12 | 13 | 14 | 15 |
| Composition, mass % | A1 | | | | | | | |
| | A2 | 50 | 49 | 64 | 62 | 67 | 68 | 65 |
| | A3 | | | | | | | |
| | A4 | | 31 | | | | | |
| | A5 | | | | | | | |
| | A6 | | | | 18 | | | |
| | A7 | | | 16 | | | | |
| | A8 | 15 | | | | 15 | 15 | 15 |
| | A9 | | | | | | | |
| | High-Viscosity Base Oil/Entire Base Oil, [mass %] | 23.1 | 0 | 0 | 0 | 18.3 | 18.1 | 18.8 |
| | B1 | 5 | 5 | 5 | 5 | 0 | 10 | 6 |
| | B2 | | | | | | | |
| | B3 | | | | | | | |
| | B4 | | | | | | | |
| | C1 | 14 | 5 | 5 | 5 | 7 | 0 | 8 |
| | C2 | 9 | 3 | 3 | 3 | 4 | | 6 |
| | C3 | | | | | | | |
| | C4 | | | | | | | |
| | D1 | 3 | 3 | 3 | 3 | 3 | 3 | 0 |
| | D2 | 4 | 4 | 4 | 4 | 4 | 4 | |
| | D3 | | | | | | | |
| | D4 | | | | | | | |
| | Rust Preventive Property Test | | | | | | | |
| Evaluation Result | 16 h | AAA | ABB | BBB | BBB | AAA | BBB | AAA |
| | 24 h | AAB | BBB | BBB | BBB | AAA | BCC | AAB |
| | 36 h | BBB | BCC | BBC | CCC | AAB | CDD | BBB |
| | 48 h | BBB | CCD | CCD | CDD | BBC | DDE | BCC |
| | Life Test | | | | | | | |
| | 1st Day | BBC | ABC | BBC | BCC | CCD | BBB | AAC |
| | 3rd Day | CCC | BBC | BBC | CCD | DDD | BBB | BBC |
| | 5th Day | DDE | BBC | BCC | CCD | DDE | BBC | CCD |
| | 10th Day | DEE | CCC | CCC | DDD | DDE | CCC | DDD |
| | Stability Test | Absence | Absence | Absence | Absence | Absence | Absence | Absence |
| | Kinematic Viscosity at 40° C., [$mm^2/s$] | 11.0 | 5.05 | 5.01 | 4.93 | 5.00 | 5.02 | 4.98 |

The invention claimed is:

1. A rust preventive oil composition containing:

a first mineral oil that is a mineral oil having a kinematic viscosity at 40° C. of 6 $mm^2/s$ or less;

a second mineral oil that is a mineral oil having a kinematic viscosity at 40° C. of 250 $mm^2/s$ or more;

2 mass % or more and 10 mass % or less, based on the total amount of the rust preventive oil composition, of a fatty acid amine salt;

4 mass % or more and 20 mass % or less, based on the total amount of the rust preventive oil composition, of an ester; and one or more rust preventive agents selected from the group consisting of a compound comprising a sarcosine group, a nonionic surfactant, a sulfonic acid salt, an amine, a carboxylic acid, a different fatty acid amine salt, a carboxylic acid salt, a paraffin wax, an oxidized wax salt, and a boron compound.

2. The rust preventive oil composition according to claim 1, further containing a third mineral oil that is a mineral oil having a kinematic viscosity at 40° C. of 10 $mm^2/s$ or more and 120 $mm^2/s$ or less.

3. The rust preventive oil composition according to claim 1, wherein an aromatic component content of the first mineral oil is 3 mass % or less based on a total amount of the first mineral oil.

4. The rust preventive oil composition according to claim 1, which when evaluated in conformity with JIS K 2246, a Grade A of rust generation, which is a rust generation of 0%, is maintained for 16 hours or more.

* * * * *